US008075077B2

(12) United States Patent
Miyamoto

(10) Patent No.: US 8,075,077 B2
(45) Date of Patent: Dec. 13, 2011

(54) METHOD OF CALCULATING CORRECTION VALUE AND METHOD OF DISCHARGING LIQUID

(75) Inventor: Toru Miyamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 438 days.

(21) Appl. No.: 12/383,788

(22) Filed: Mar. 27, 2009

(65) Prior Publication Data

US 2009/0244153 A1 Oct. 1, 2009

(30) Foreign Application Priority Data

Mar. 27, 2008 (JP) ..... 2008-084703

(51) Int. Cl.
*B41J 29/393* (2006.01)

(52) U.S. Cl. ..... 347/15; 347/19

(58) Field of Classification Search ..... 347/15, 347/19

See application file for complete search history.

(56) References Cited

U.S. PATENT DOCUMENTS 6,390,583 B1 * 5/2002 Kato et al. ..... 347/15
7,950,768 B2 * 5/2011 Yoshida et al. ..... 347/19

FOREIGN PATENT DOCUMENTS

JP 2006-305952 11/2006

* cited by examiner

*Primary Examiner* — Laura Martin
(74) *Attorney, Agent, or Firm* — Nutter McClennen & Fish LLP; John J. Penny, V.

(57) ABSTRACT

A method of calculating a correction value including: forming a first test pattern on a medium by using a first nozzle group and a second nozzle group and a third nozzle group of a liquid discharging device, forming a second test pattern on the medium, setting the first test pattern in a scanner, setting the second test pattern in the scanner, acquiring a read-out result of a portion formed by the second nozzle group, and acquiring a read-out result of a portion formed by the third nozzle group from a read-out result of the second test pattern as a fourth read-out gray scale value, converting the first read-out gray scale value, the second read-out gray scale value, the third read-out gray scale value, and the fourth read-out gray scale value into corrected read-out gray scale values, and calculating a correction value based on the corrected read-out gray scale values.

9 Claims, 24 Drawing Sheets

FIG. 18

| ROW AREA NUMBER | CYAN | | | | |
|---|---|---|---|---|---|
| | Sa | Sb | Sc | Sd | Se |
| 1 | Ha_1 | Hb_1 | Hc_1 | Hd_1 | He_1 |
| 2 | Ha_2 | Hb_2 | Hc_2 | Hd_2 | He_2 |
| 3 | Ha_3 | Hb_3 | Hc_3 | Hd_3 | He_3 |
| ⋮ | | | ⋮ | | |
| N−1 | Ha_N−1 | Hb_N−1 | Hc_N−1 | Hd_N−1 | He_N−1 |
| 180×n=N | Ha_N | Hb_N | Hc_N | Hd_N | He_N |

METHOD OF CALCULATING CORRECTION VALUE AND METHOD OF DISCHARGING LIQUID

BACKGROUND

1. Technical Field

The present invention relates to a method of calculating a correction value and a method of discharging liquid.

2. Related Art

As one type of liquid discharging devices, there are ink jet printers that perform a printing operation by discharging ink on various media such as a sheet, a cloth, or a film from a nozzle. Recently, as one type of the ink jet printers, line head printers having a nozzle row of a length corresponding to the sheet width in a predetermined direction intersecting a transport direction of a medium have been developed.

Non-uniformity of density may occur due to a problem such as precision of nozzle processing, landing of ink droplets in an inappropriate position on the medium, or a difference of ink discharging amounts. Thus, a correction value is calculated such that an image piece that is visually recognized thin is printed thick and an image piece that is visually recognized thick is printed thin. Accordingly, an actual test pattern is printed by the printer. Then, a method in which the test pattern is read out by the scanner, and a correction value is calculated based on the read-out result has been proposed (for example, JP-A-2006-305952).

In a printer having a long head, a long test pattern in a predetermined direction is printed. However, there is limit on the range in which the test pattern can be read out by the scanner. Accordingly, a test pattern that is printed by the printer having a long head cannot be read out by the scanner, and therefore, a correction value cannot be calculated.

Thus, a method of calculating a correction value of the printer having the long head is needed.

SUMMARY

An advantage of some aspects of the invention is that it provides a method of calculating a correction value and a method of discharging liquid.

According to a major aspect of the invention, there is provided a method of calculating a correction value. The method includes: forming a first test pattern on a medium by using a first nozzle group and a second nozzle group of a liquid discharging device including a nozzle row, in which a plurality of nozzles for discharging liquid is aligned in a predetermined direction, having the first nozzle group, the second nozzle group, and a third nozzle group; forming a second test pattern on the medium by using the second nozzle group and the third nozzle group of the liquid discharging device; setting the first test pattern in a scanner, acquiring a read-out result of a portion formed by the first nozzle group from a read-out result of the first test pattern as a first read-out gray scale value, and acquiring a read-out result of a portion formed by the second nozzle group from a read-out result of the first test pattern as a second read-out gray scale value; setting the second test pattern other than the first test pattern in the scanner, acquiring a read-out result of a portion formed by the second nozzle group from a read-out result of the second test pattern as a third read-out gray scale value, and acquiring a read-out result of a portion formed by the third nozzle group from a read-out result of the second test pattern as a fourth read-out gray scale value; converting the first read-out gray scale value, the second read-out gray scale value, the third read-out gray scale value, and the fourth read-out gray scale value into corrected read-out gray scale values by correcting at least one between the read-out result of the first test pattern and the read-out result of the second test pattern based on a difference between the second read-out gray scale value and the third read-out gray scale value; and calculating a correction value based on the corrected read-out gray scale values.

Other aspects of an embodiment of the invention will be apparent by descriptions here and accompanying drawings.

BRIEF DESCRIPTION OF THE DRAWINGS

The invention will be described with reference to the accompanying drawings, wherein like numbers reference like elements.

FIG. 18 is a correction table.

DESCRIPTION OF EXEMPLARY EMBODIMENTS

Figure 1:
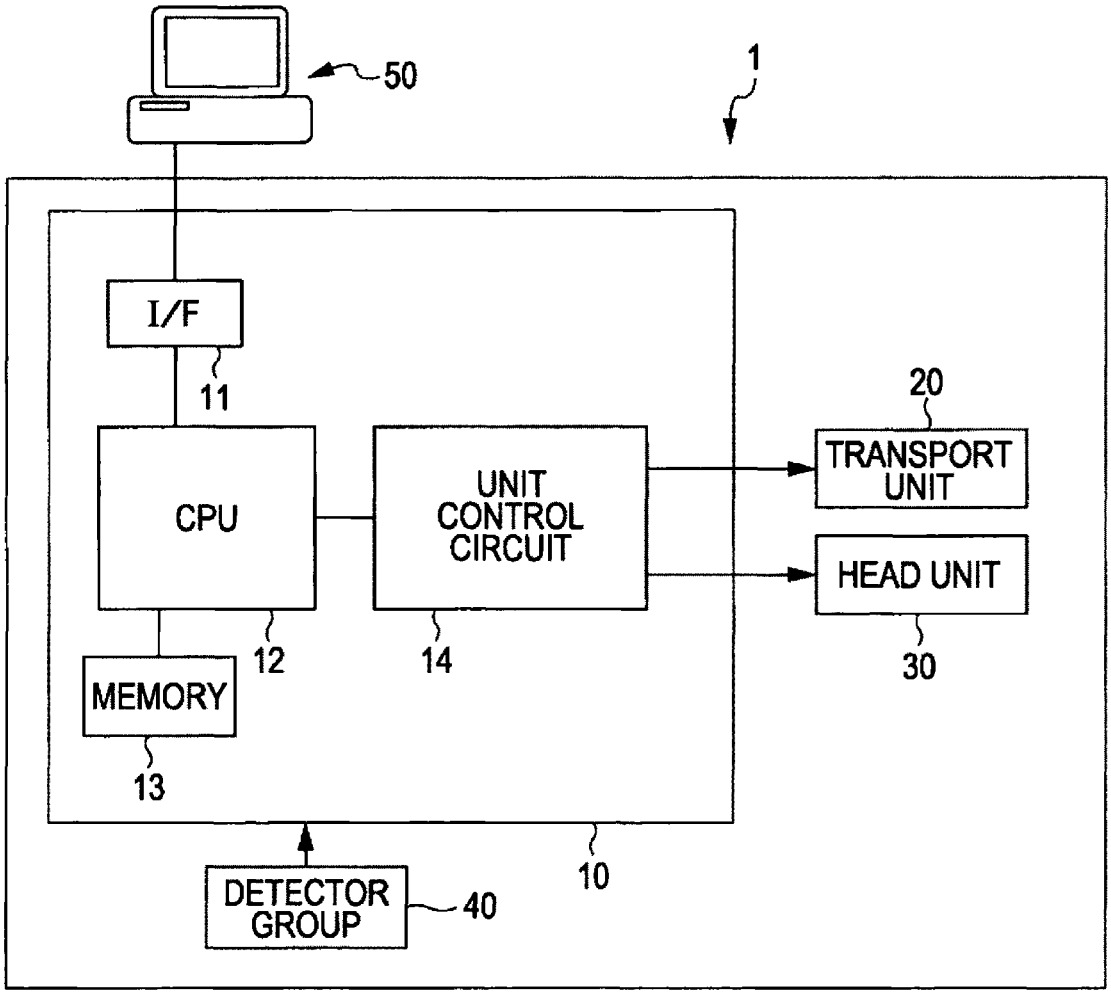
FIG. 1 is a block diagram showing the whole configuration of a printer according to an embodiment of the invention.

By descriptions here and description of the attached drawings, at least the followings become apparent.

According to a first aspect of the invention, there is provided a method of calculating a correction value. The method includes: forming a first test pattern on a medium by using a first nozzle group and a second nozzle group of a liquid discharging device including a nozzle row, in which a plurality of nozzles for discharging liquid is aligned in a predetermined direction, having the first nozzle group, the second nozzle group, and a third nozzle group; forming a second test pattern on the medium by using the second nozzle group and the third nozzle group of the liquid discharging device; setting the first test pattern in a scanner, acquiring a read-out result of a portion formed by the first nozzle group from a read-out result of the first test pattern as a first read-out gray scale value, and acquiring a read-out result of a portion formed by the second nozzle group from a read-out result of the first test pattern as a second read-out gray scale value; setting the second test pattern other than the first test pattern in the scanner, acquiring a read-out result of a portion formed by the second nozzle group from a read-out result of the second test pattern as a third read-out gray scale value, and acquiring a read-out result of a portion formed by the third nozzle group from a read-out result of the second test pattern as a fourth read-out gray scale value; converting the first read-out gray scale value, the second read-out gray scale value, the third read-out gray scale value, and the fourth read-out gray scale value into corrected read-out gray scale values by correcting at least one between the read-out result of the first test pattern and the read-out result of the second test pattern based on a difference between the second read-out gray scale value and the third read-out gray scale value; and calculating a correction value based on the corrected read-out gray scale values.

According to the above-described method of calculating the correction value, for the read-out results of test patterns that are not simultaneously read out by the scanner, the read-out error of the scanner can be corrected, and thereby a correction value can be calculated more accurately.

In the above-described method of calculating the correction value, it may be configured that the first nozzle group, the second nozzle group, and the third nozzle group are aligned in the described order from one side in the predetermined direction, and, in the converting of the first to fourth read-out gray scale values into the corrected read-out gray scale values, the difference between the second read-out gray scale value and the third read-out gray scale value is calculated based on a difference between an average value of the second read-out gray scale values of the second nozzle group, from which the read-out result of the first test pattern formed by the nozzle located in an end portion on the other side is excluded, and an average value of the third read-out gray scale values of the second nozzle group from which the read-out result of the second test pattern formed by the nozzle located in an end portion on the one side is excluded.

In such a case, the read-out result of the first test pattern that is formed by a nozzle located in the end portion on the other side of the second nozzle group and the read-out result of the second test pattern formed by the nozzle located in the end portion on the one side of the second nozzle group may be influenced by the background color of the medium. Accordingly, by calculating the difference between the second read-out gray scale value and the third read-out gray scale value with such read-out results excluded, the read-out error of the scanner can be corrected more accurately.

In the above-described method of calculating the correction value, it may be configured that the first nozzle group, the second nozzle group, and the third nozzle group are aligned in the described order from one side in the predetermined direction, and the first nozzle group, the second nozzle group, and the third nozzle group belong to different heads, and, in the converting of the first to fourth read-out gray scale values into the corrected read-out gray scale values, the difference between the second read-out gray scale value and the third read-out gray scale value is calculated based on a difference between an average value of the second read-out gray scale values of the second nozzle group, from which the read-out result of the first test pattern formed by the nozzle located in an end portion on the one side is excluded, and an average value of the third read-out gray scale values of the second nozzle group from which the read-out result of the second test pattern formed by the nozzle located in an end portion on the other side is excluded.

In such a case, there is a difference between the read-out results for different heads. Accordingly, the read-out result of the first test pattern formed by the nozzle of the second nozzle group that is located in an end portion in one direction and the read-out result of the second test pattern formed by the nozzle of the second nozzle group that is formed by the nozzle located in an end portion on the other side may be influenced by the read-out results of other heads. Thus, by calculating the difference between the second read-out gray scale value and the third read-out gray scale value with such read-out results excluded, the read-out error of the scanner can be corrected more accurately.

In the above-described method of calculating the correction value, the corrected read-out gray scale value corresponding to the third nozzle group may be the fourth read-out gray scale value that is corrected by the difference between the second read-out gray scale value and the third read-out gray scale value.

In such a case, the read-out error of the scanner can be corrected.

In the above-described method of calculating the correction value, it may be configured that the corrected read-out gray scale value corresponding to the first nozzle group is the first read-out gray scale value that is corrected by a part of the difference between the second read-out gray scale value and the third read-out gray scale value, the corrected read-out gray scale value corresponding to the second nozzle group is the second read-out gray scale value that is corrected by a part of the difference, and the corrected read-out gray scale value corresponding to the third nozzle group is the fourth read-out gray scale value that is corrected by a remaining amount of the difference between the second read-out gray scale value and the third read-out gray scale value from which the part is excluded.

In such a case, the read-out error of the scanner can be corrected.

In the above-described method of calculating the correction value, it may be configured that the first nozzle group, the second nozzle group, and the third nozzle group are aligned in the described order from one side in the predetermined direction, the first test pattern is formed on the medium by using the first nozzle group, the second nozzle group, and the nozzle of the third nozzle group that is located on an end portion on the one side, and the second test pattern is formed on the medium by using the nozzle of the first nozzle group that is located in an end portion on the other side, the second nozzle group, and the third nozzle group.

In such a case, the correction value can be calculated more accurately based on the read-out result that is not influenced by the background color of the medium.

In the above-described method of calculating the correction value, it may be configured that the first nozzle group, the second nozzle group, and the third nozzle group are aligned in the described order from one side in the predetermined direction, the corrected read-out gray scale value corresponding to an end portion of the second nozzle group on the one side is the second read-out gray scale value that is corrected by the difference between the second read-out gray scale value and the third read-out gray scale value, and the corrected read-out gray scale value corresponding to an end portion of the second nozzle group on the other side is the third read-out gray scale value that is corrected by the difference between the second read-out gray scale value and the third read-out gray scale value.

In such a case, the correction value can be calculated more accurately based on the read-out result that is not influenced by the background color of the medium.

According to a second aspect of the invention, there is provided a method of discharging liquid. The method includes: forming a first test pattern on a medium by using a first nozzle group and a second nozzle group of a liquid discharging device including a nozzle row, in which a plurality of nozzles for discharging liquid is aligned in a predetermined direction, having the first nozzle group, the second nozzle group, and a third nozzle group; forming a second test pattern on the medium by using the second nozzle group and the third nozzle group of the liquid discharging device; setting the first test pattern in a scanner, acquiring a read-out result of a portion formed by the first nozzle group from a read-out result of the first test pattern as a first read-out gray scale value, and acquiring a read-out result of a portion formed by the second nozzle group from a read-out result of the first test pattern as a second read-out gray scale value; setting the second test pattern other than the first test pattern in the scanner, acquiring a read-out result of a portion formed by the second nozzle group from a read-out result of the second test pattern as a third read-out gray scale value, and acquiring a read-out result of a portion formed by the third nozzle group from a read-out result of the second test pattern as a fourth read-out gray scale value; converting the first read-out gray scale value, the second read-out gray scale value, the third read-out gray scale value, and the fourth read-out gray scale value into corrected read-out gray scale values by correcting at least one between the read-out result of the first test pattern and the read-out result of the second test pattern based on a difference between the second read-out gray scale value and the third read-out gray scale value; calculating a correction value based on the corrected read-out gray scale values; and correcting a gray scale value represented by image data by using the correction value and discharging liquid based on a corrected gray scale value by using the liquid discharging device.

According to the above-described method of discharging liquid, the gray scale value is corrected by using a correction value in which the read-out error of the scanner is corrected, and thereby non-uniformity of liquid discharge can be prevented. For example, when the liquid discharging device is a printer, the non-uniformity of density can be prevented.

According to a third aspect of the invention, there is provided a method of calculating a correction value. The method includes: forming a first test pattern having a first dot row group and a second dot row group on a medium by using a liquid discharging device that alternately repeats forming a dot row, in which dots are aligned in an intersection direction, with a nozzle row, in which a plurality of nozzles for discharging liquid is aligned in a predetermined direction, and the medium relatively moved in the intersection direction intersecting the predetermined direction and relatively moving the nozzle row and the medium in the predetermined direction; forming a second test pattern having a second dot row group and a third dot row group on the medium by using the liquid discharging device; setting the first test pattern in a scanner, acquiring a read-out result of the first dot row group as a first read-out gray scale value, and acquiring a read-out result of the second dot row group as a second read-out gray scale value; setting the second test pattern other than the first test pattern in the scanner, acquiring a read-out result of the second dot row group as a third read-out gray scale value, and acquiring a read-out result of the third dot row group as a fourth read-out gray scale value; converting the first read-out gray scale value, the second read-out gray scale value, the third read-out gray scale value, and the fourth read-out gray scale value into corrected read-out gray scale values by correcting at least one between the read-out result of the first test pattern and the read-out result of the second test pattern based on a difference between the second read-out gray scale value and the third read-out gray scale value; and calculating a correction value based on the corrected read-out gray scale values.

According to the above-described method of calculating the correction value, the read-out error of the scanner can be corrected, and whereby the correction value can be calculated more accurately.

Line Head Printer

Hereinafter, an ink jet printer as a liquid discharging apparatus according to an embodiment of the invention, and more particularly, a line head printer (printer 1) as one type of the ink jet printer will be described as an example.

Figure 2A:
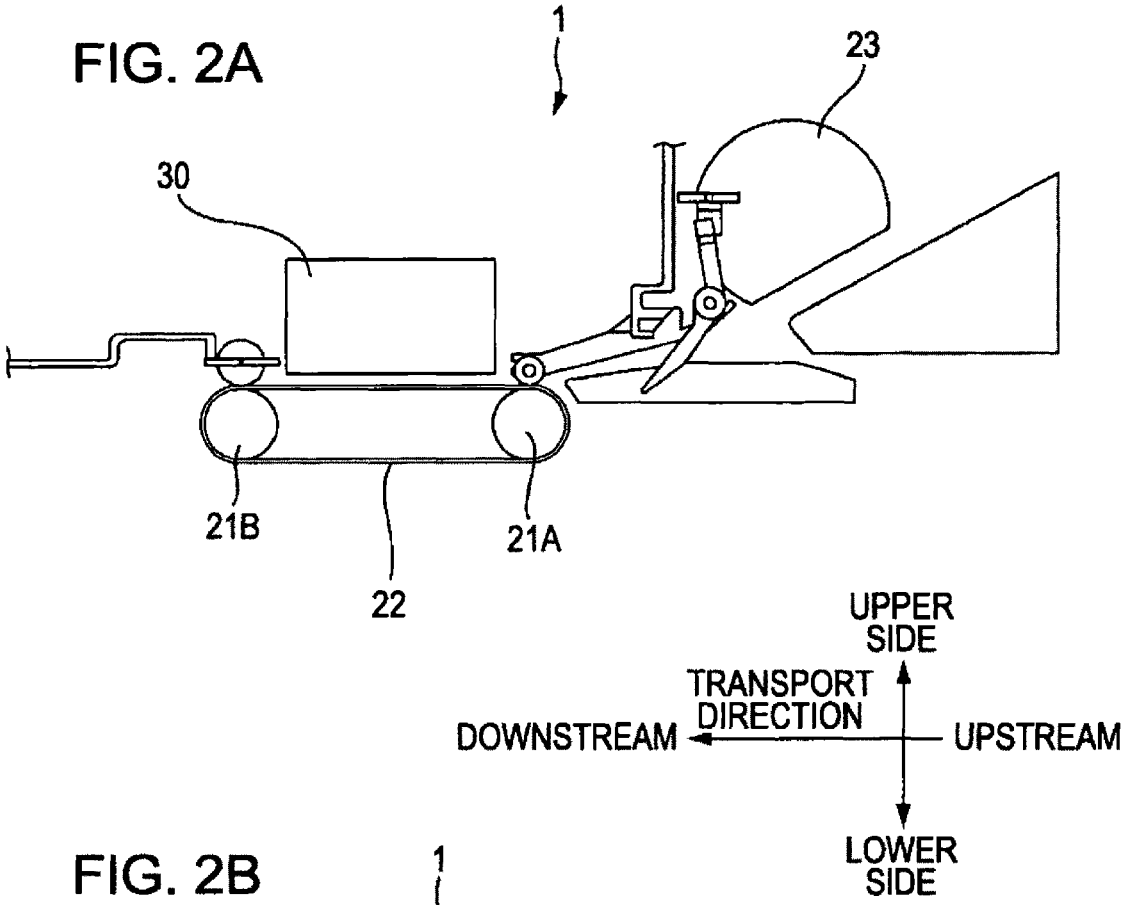
FIG. 2A is a cross-section view of the printer.
Figure 2B:
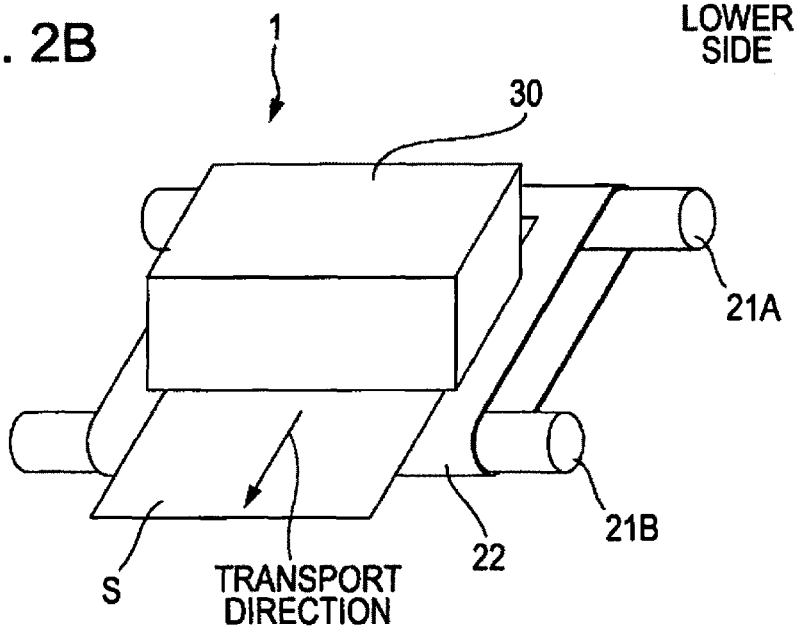
FIG. 2B is a diagram showing an appearance of transporting a medium.

FIG. 1 is a block diagram showing the whole configuration of a printer 1 according to this embodiment. FIG. 2A is a cross-section view of the printer 1. FIG. 2B is a diagram showing the appearance of transporting a sheet S (medium) in the printer 1. The printer 1 that receives print data from a computer 50 as an external apparatus forms an image on a sheet S by controlling units (a transport unit 20 and a head unit 30) by using a controller 10. In addition, a detector group 40 monitors the internal state of the printer 1, and the controller 10 controls the units based on the result of detection.

The controller 10 is a control unit that is used for performing a control operation for the printer 1. An interface unit 11 is used for transmitting and receiving data between the computer 50 as an external apparatus and the printer 1. A CPU 12 is an arithmetic processing device that is used for controlling the entire printer 1. A memory 13 is used for securing an area for storing a program of the CPU 12, a work area, and the like. The CPU 12 controls each unit based on the program that is stored in the memory 13 by using the unit control circuit 14.

A transport unit 20 includes transport rollers 21A and 21B and a transport belt 22. The transport unit 20 transports a sheet S to a printable position and transports the sheet S in the transport direction at a predetermined transport speed in a printing process. A feed roller 23 is a roller that is used for automatically feeding the sheet S that is inserted into a paper inserting port on the transport belt 22 inside the printer 1. The transport belt 22 having a ring shape is rotated by the transport rollers 21A and 21B, and whereby the sheet S on the transport belt 22 is transported. In addition, electrostatic adsorption or vacuum adsorption is performed for the sheet on the transport belt 22 from the lower side.

The head unit 30 is used for discharging ink on a sheet and includes a plurality of heads 31. On a lower face of the head 31, a plurality of nozzles as ink discharging units is disposed. In each nozzle, a pressure chamber (not shown) in which ink is inserted and a driving element (piezo element) that is used for discharging ink by changing the volume of the pressure chamber are disposed.

Figure 3:
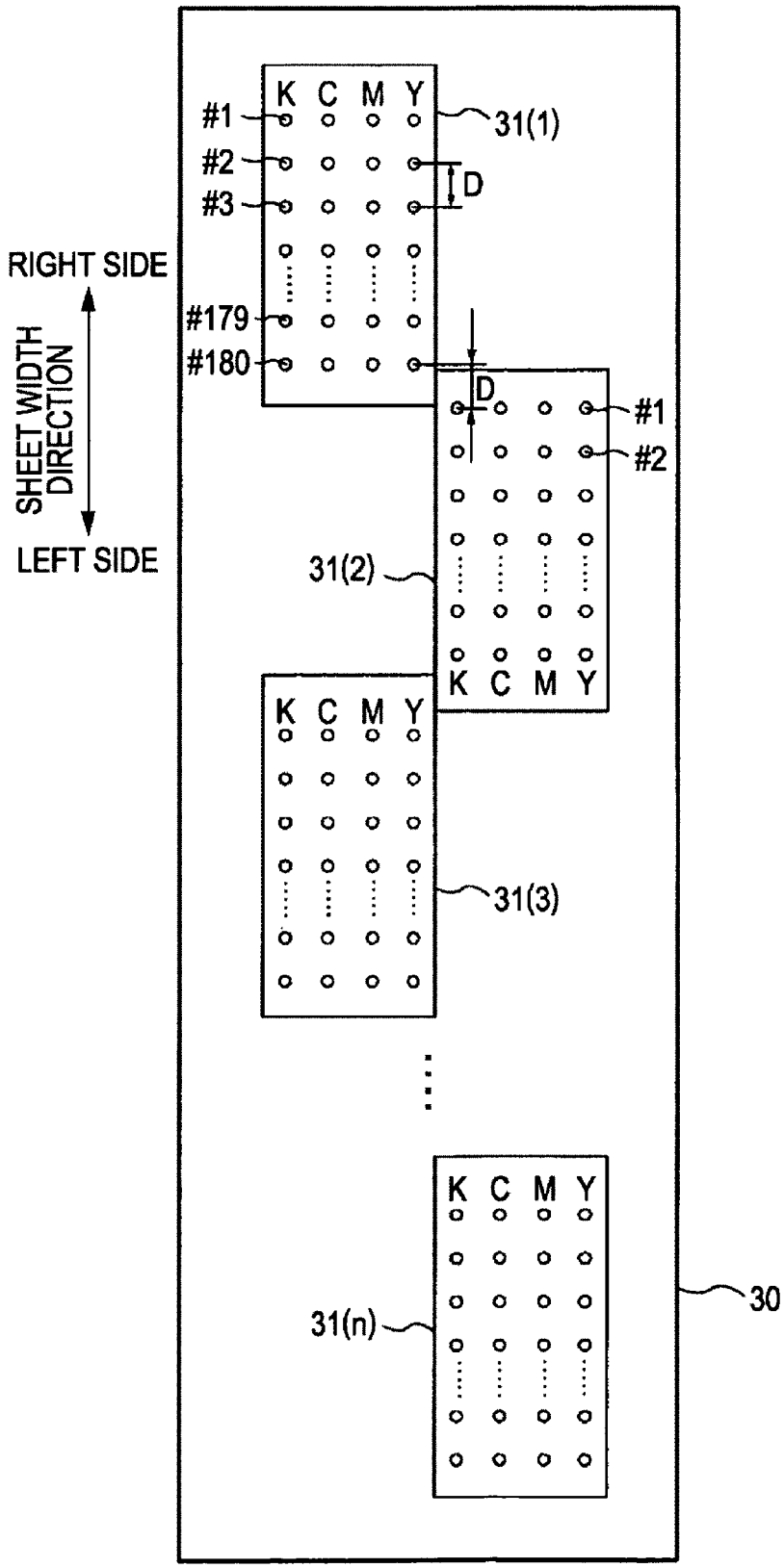
FIG. 3 is a diagram showing a nozzle arrangement on a lower face of a head unit.

FIG. 3 shows a nozzle arrangement on the lower face of the head unit 30. The head unit 30 includes a plurality of (n) heads 31. From a head 31 located on the right side in the sheet width direction (corresponds to a predetermined direction), a first head 31 (1), a second head 31 (2), . . . , an n-th head 31(*n*) are sequentially disposed. The plurality of the heads 31 is disposed so as to be aligned in a zigzag pattern in the sheet width direction that intersects the transport direction. On the lower face of the head 31, a yellow ink nozzle row Y, a magenta ink nozzle row M, a cyan ink nozzle row C, and a black ink nozzle row K are formed, and each nozzle row has 180 nozzles. The nozzles of each nozzle row are aligned in the sheet width direction with a predetermined distance D interposed therebetween.

In addition, the heads 31 are disposed such that a distance between the rightmost nozzle (for example, #1 of 31(2)) of the left head between two heads 31 aligned in the sheet width direction and the leftmost nozzle (for example, #180 of 31(1)) of the right head is a predetermined distance D. In other words, within the head unit 30, nozzles (YMCK) of four colors are aligned in the sheet width direction with a predetermined distance D interposed therebetween.

In such a line head printer, when the controller 10 receives print data, the controller 10, first, rotates the feed roller 23 so as to transmit a sheet S to be printed on the transport belt 22. The sheet S is transported on the transport belt 22 at a constant speed without stopping and passes below the head unit 30. While the sheet S passes below the head unit 30, ink is intermittently discharged from each nozzle. As a result, a dot row formed of a plurality of dots in the transport direction is formed on the sheet S, and whereby an image is printed.

Non-Uniformity of Density

For description below, a "pixel area" and a "row area" are defined here. The pixel area represents a rectangular area that is virtually determined on a sheet. The size and the shape of the pixel area are determined in accordance with the printing resolution. One "pixel" that configures image data corresponds to one pixel area. In addition, a "row area" is an area located on the sheet which is configured by a plurality of the pixel areas aligned in the transport direction. A "pixel row" of data in which pixels are aligned in a direction facing the transport direction corresponds to one row area.

Figure 4A:
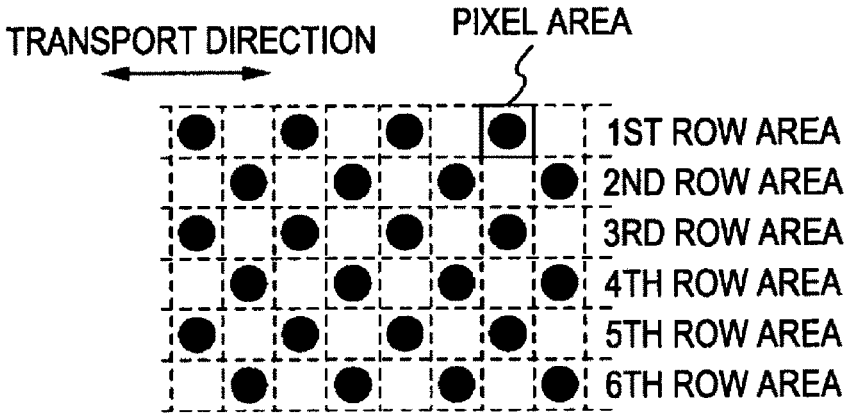
FIG. 4A is a diagram showing ideal dot formation.

FIG. 4A is an explanatory diagram showing appearance of a case where dots are formed ideally. To form a dot ideally means that an ink droplet lands in a center position of a pixel area, the ink droplet spreads on the sheet, and a dot is formed in a pixel area. When each dot is accurately formed in each pixel area, a raster line (a dot row in which dots are aligned in the transport direction) is formed accurately in a row area.

Figure 4B:
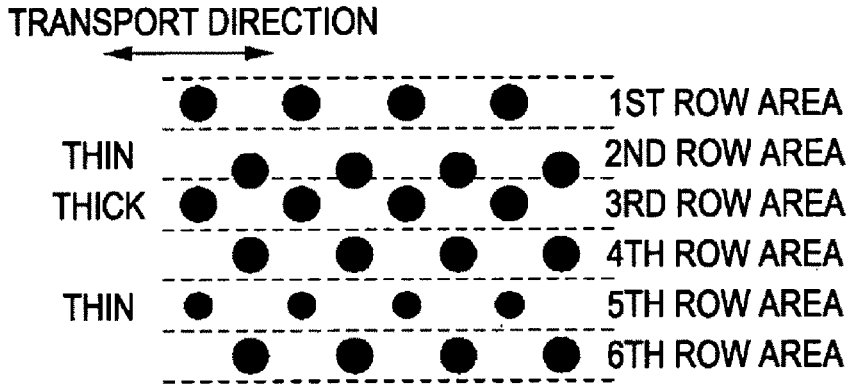
FIG. 4B is a diagram showing non-uniformity of density.

FIG. 4B is an explanatory diagram of a case where non-uniformity of density occurs. A raster line that is formed in the second row area is formed to be brought near the third row area due to variation of the flying direction of ink droplets discharged from the nozzle. As a result, the second row area becomes thin, and the third row area becomes thick. In addition, the ink amount of ink droplets discharged to the fifth row area is smaller than a regulated ink amount, and accordingly, dots formed in the fifth row area are small. As a result, the fifth row area becomes thin.

When a printed image that is formed of raster lines having different density is viewed macroscopically, non-uniformity of density having a striped shape in the transport direction is visually recognized. This non-uniformity of density becomes a reason for degrading the image quality of the printed image.

Figure 4C:
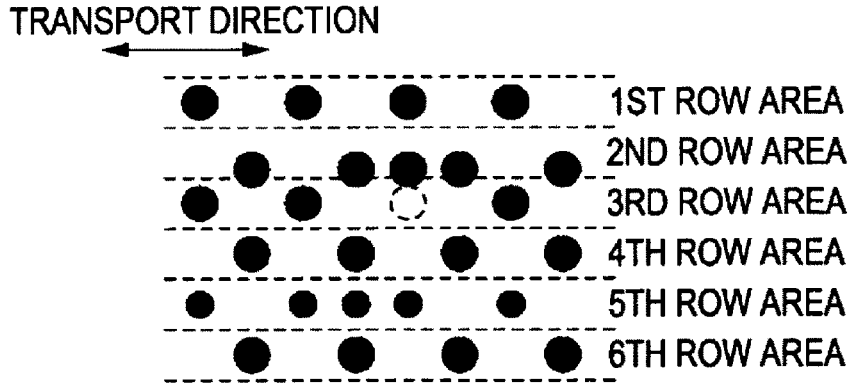
FIG. 4C is a diagram showing dot formation according to an embodiment of the invention.

FIG. 4C is an explanatory diagram showing appearance of a case where dots are formed by using a printing method according to this embodiment. According to this embodiment, for a row area that can be easily recognized to be thick, the gray scale values of pixel data of pixels corresponding to the row area are corrected so as to form a thin image piece. On the other hand, for a row area that can be easily recognized to be thin, the gray scale values of the pixel data of pixels corresponding to the row area are corrected so as to form a thick image piece.

For example, in FIG. 4C, gray scale values of pixel data of pixels corresponding to each row area are corrected such that dot generation ratios of the second and the fifth row areas recognized to be thin is increased and the dot generation ratio of the third row area recognized to be thick is decreased. Accordingly, the dot generation ratio for the raster line of each row area is changed, and thereby the density of an image piece of a row area is corrected. Therefore, the density non-uniformity of the entire printed image is suppressed.

In FIG. 4B, the reason that the density of an image piece that is formed in the third row area becomes thick is not by the influence of a nozzle that forms the raster line in the third row area but by the influence of a nozzle that forms a raster line in the adjacent second row area. Accordingly, when the nozzle that forms the raster line in the third row area forms a raster line in a different row area, it cannot be determined that an image piece formed in the row area becomes thick. In other words, even for image pieces that are formed by a same nozzle, when a nozzle that forms an adjacent image piece is different, the density may be different. In such a case, the non-uniformity of density cannot be suppressed by using correction values corresponding to the nozzles only. Accordingly, in this embodiment, a gray scale value of the pixel data is corrected based on a correction value set for each row area.

Method of Calculating Correction Value

First Embodiment

Figure 5:
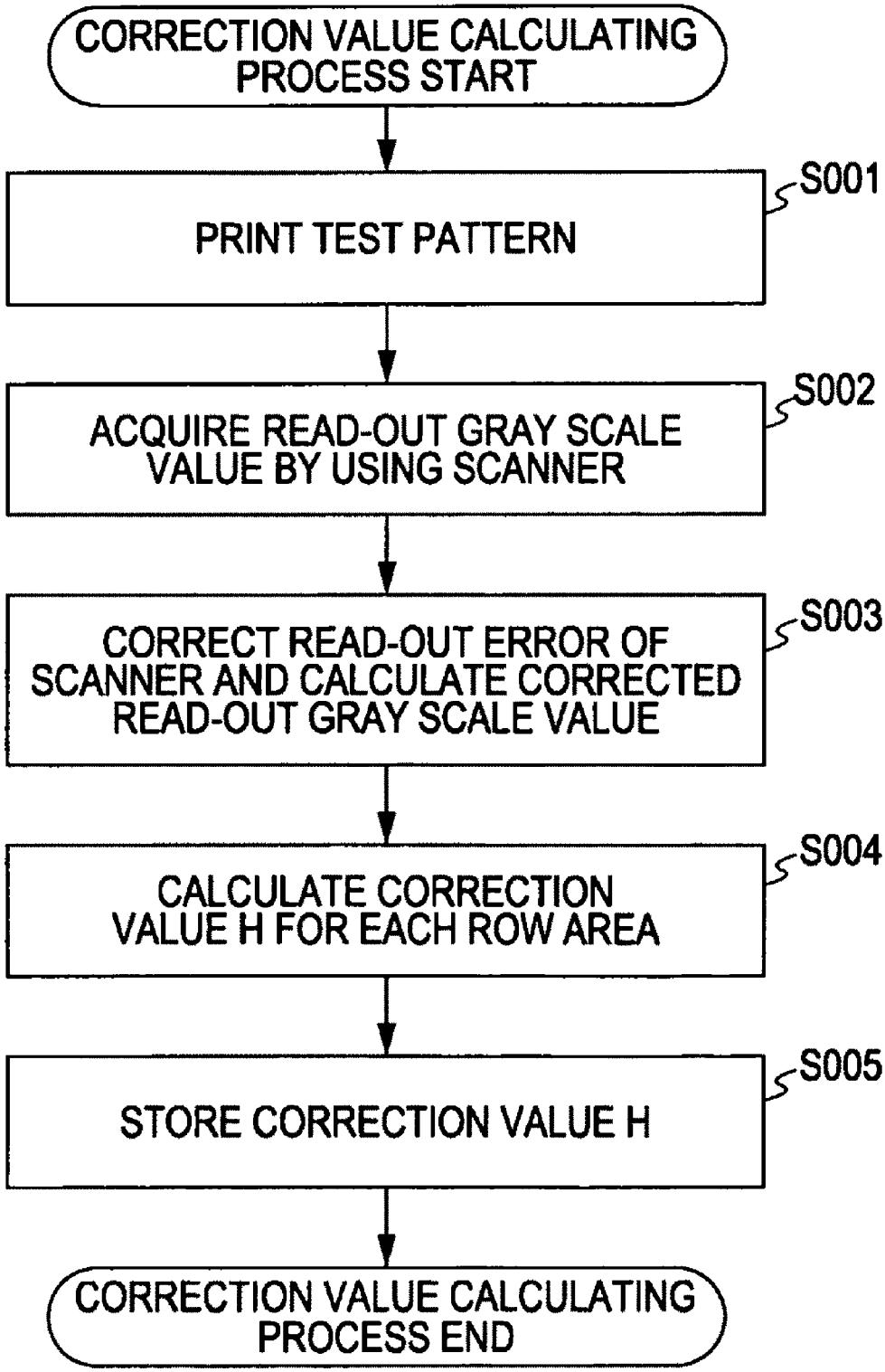
FIG. 5 is a flowchart of a method of calculating a correction value.

FIG. 5 is a flowchart of a method of calculating a correction value that is performed in a test process after manufacture of a printer. For the test, the printer 1 to be tested for non-uniformity of density and a scanner are connected to a computer 50. According to this embodiment, in order to calculate the correction value H for each row area, first, a test pattern is actually printed by the printer 1 (S001). Then, the test pattern is read out by the scanner (S002). At the same time, the read-out error of the scanner in the read-out result of the test pattern that is not simultaneously read by the scanner is corrected (S003). For a row area in which a printing operation is performed to be thicker than a target density (gray scale value), a correction value H for having the row area to be printed thinner is calculated. On the contrary, for a row area in which a printing operation is performed to be thinner than the target density (gray scale value), a correction value H for having the row area to be printed thicker is calculated (S004). In addition, in the computer 50, a printer driver, a scanner driver, and a correction value calculating program are installed in advance. Accordingly, the computer 50 prints a test pattern in accordance with the printer driver, the test pattern is read out in accordance with the scanner driver, and the correction value H is calculated in accordance with the correction value calculating program.

Figure 6A:
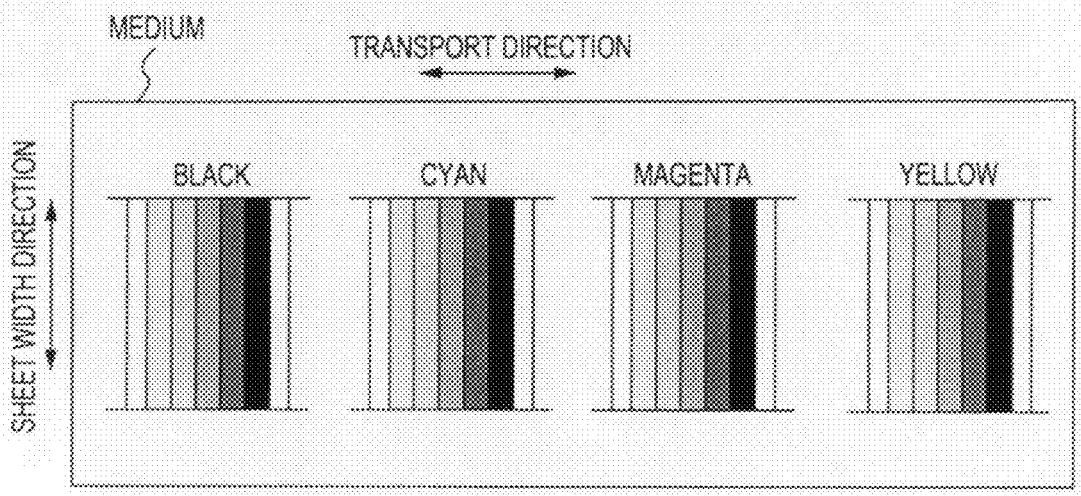
FIG. 6A is a diagram showing a test pattern.
Figure 6B:
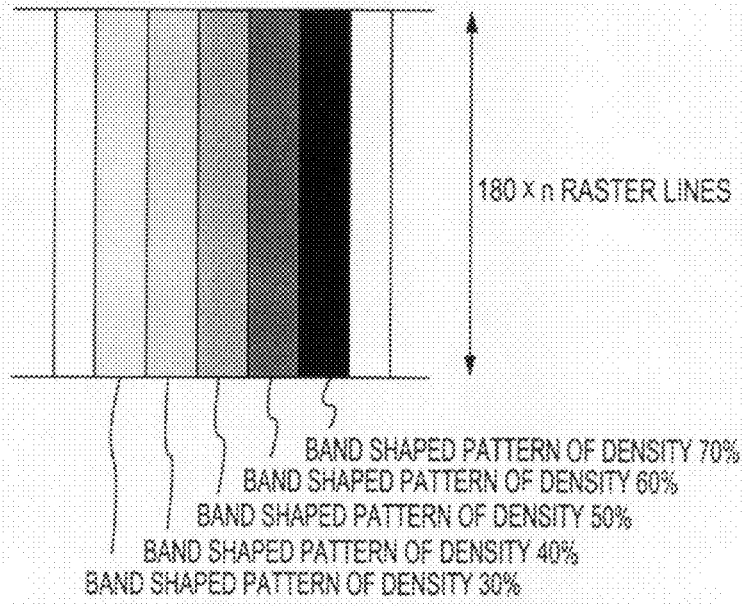
FIG. 6B is a diagram showing a correction pattern.

FIG. 6A is a diagram showing a test pattern to be printed by the printer 1, and FIG. 6B is a diagram showing a correction pattern. The test pattern is configured by four correction patterns that are formed for each nozzle row of different colors (cyan, magenta, yellow, and black). Each correction pattern is configured by band-shaped patterns of five types of density. The band-shaped patterns are generated based on image data of predetermined gray scale values. The gray scale value of the band-shaped pattern is referred to as a directed gray scale value. In addition, a directed gray scale value of a band-shaped pattern of density 30% is denoted by Sa(76), a directed gray scale value of a band-shaped pattern of density 40% is denoted by Sb(102), a directed gray scale value of a band-shaped pattern of density 50% is denoted by Sc(128), a directed gray scale value of a band-shaped pattern of density 60% is denoted by Sd(153), and a directed gray scale value of a band-shaped pattern of density 70% is denoted by Se(178).

In the line head printer 1 according to this embodiment, an image is printed on a sheet by transporting the sheet under the head unit 30 without moving the head unit 30. In addition, in a printer like the printer 1 according to this embodiment that does not have a plurality of the head units 30 (FIG. 3), one nozzle corresponds to one row area (one pixel row). In such a case, a maximum image that can be printed by the printer 1 is configured by raster lines (dot rows aligned in the transport direction) corresponding to the number of nozzles (180×n) that are included in the printer 1. In other words, raster lines are formed by each nozzle for 180×n row areas on the sheet. Accordingly, the number of the correction values H to be calculated is 180×n, and the correction pattern is configured by 180×n raster lines. In addition, a right nozzle in the sheet width direction, that is, a row area corresponding to nozzle #1 of the first head 31(1) is set as the first row area.

Figure 7:
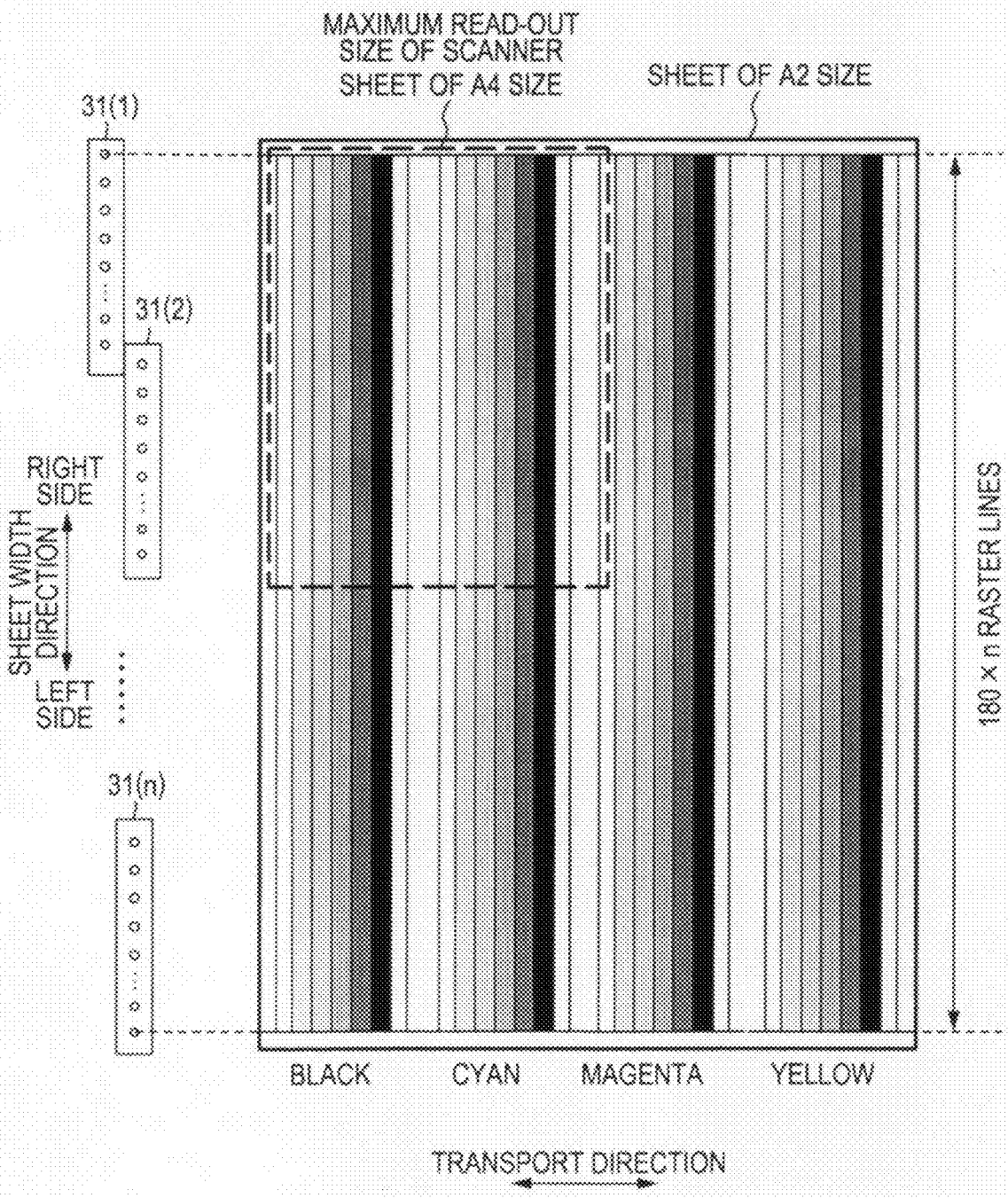
FIG. 7 is a diagram showing a test pattern of the printer 1.

FIG. 7 is a diagram showing a test pattern of the printer 1 that can print a sheet of A2 size. In a printer that can print a large sheet of A2 size, a plurality of the heads 31 (nozzles) is aligned in the sheet width direction by that much, and accordingly, the length of the correction pattern to be printed in the sheet width direction is increased. However, there is limit for the read-out range of the scanner. For example, for a case where the maximum read-out size of the scanner is A4 size (a dotted part in the figure), when the test pattern printed in a sheet of A2 size is set for the scanner, only a part of the correction pattern can be read out.

Thus, according to the first embodiment, for a case where a correction value H of the printer 1 that prints a sheet of a size (for example, a sheet of A2 size) larger than the readable range of the scanner, the correction pattern is divided into several parts and printed on sheets (for example, sheets of A4 size) that can be read out by the scanner. Accordingly, the entire correction pattern can be read out by the scanner.

Figure 8:
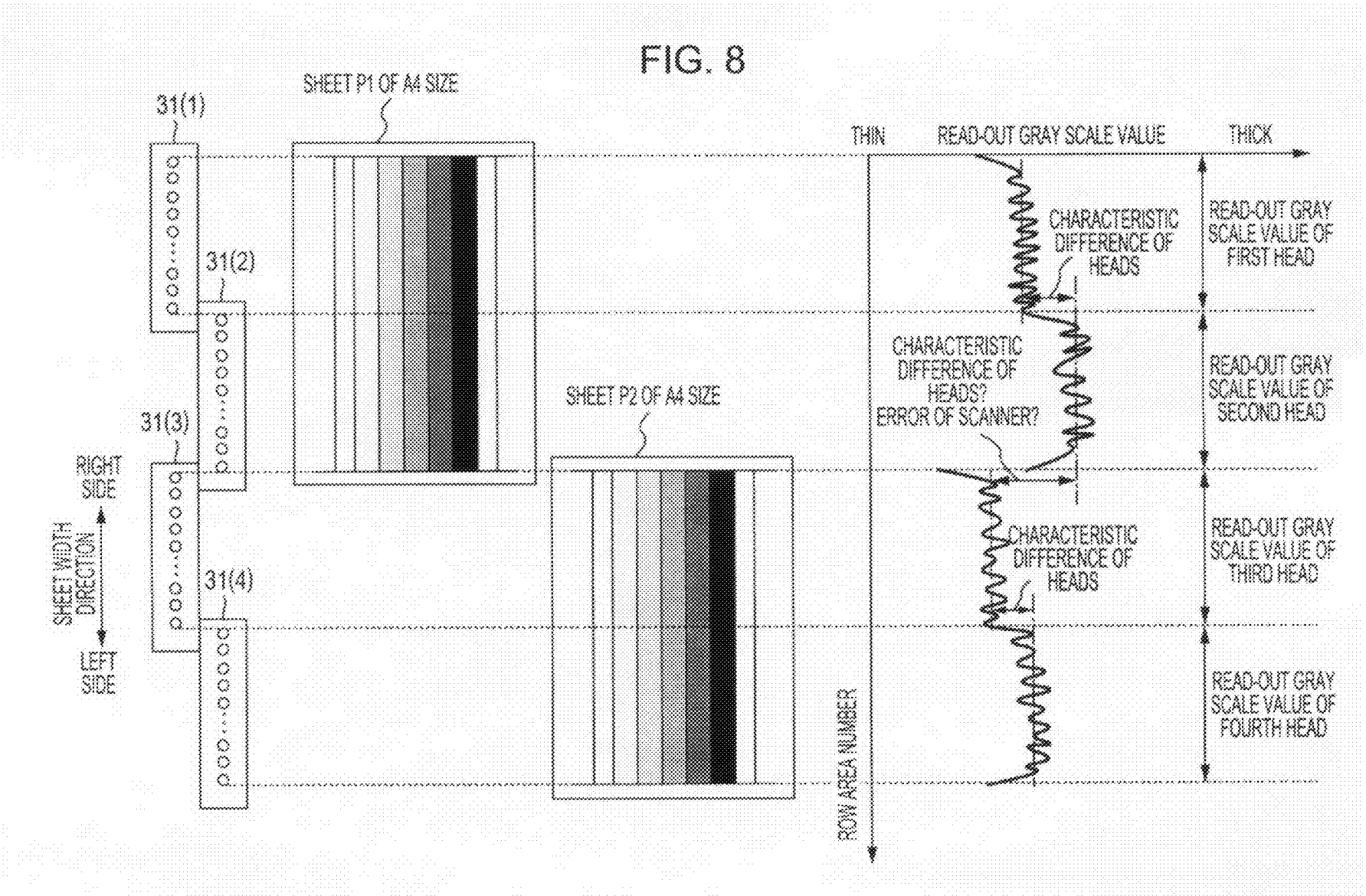
FIG. 8 is a diagram showing a method of printing a test pattern and a read-out result according to a comparative example.

FIG. 8 is a diagram showing a method of printing a test pattern and a result of reading out a correction pattern by using the scanner according to a comparative example that is different from this embodiment. For the convenience of description, the number of the heads is decreased, and only a correction pattern of a nozzle row of one color is exemplified. In the comparative example, a correction pattern is printed on one sheet P1 of A4 size by a first head 31(1) and a second head 31(2). Then, a correction pattern is printed on another sheet P2 of A4 size by a third head 31(3), and a fourth head 31(4). Then, the first sheet P1 is set in the scanner, the correction pattern printed on the sheet P1 is read out by the scanner, then, the sheet P1 is separated from the scanner, the second sheet P2 is set in the scanner, and the correction pattern printed on the sheet P2 is read out by the scanner. As a result, all the correction patterns that are formed by the printer 1 can be read out.

After the correction pattern is read out by the scanner, the image data of the read-out correction pattern is adjusted such that the number of pixel rows in which pixels are aligned in a direction corresponding to the sheet width direction and the number of raster lines (the number of row areas) that configures the correction pattern are the same. In other words, the pixel rows read out by the scanner and the row areas are associated with each other as one-to-one matching. Then, an average value of the read-out gray scale values denoted by the pixels of a pixel row corresponding to a row area is set as the read-out gray scale value of the row area. The read-out result shown in FIG. 8 is a result of reading a band-shaped pattern that is formed based on a directed gray scale value. In the figure, the vertical direction represents the row area number, and the horizontal direction represents a read-out gray scale value of the row area. Towards the right side in the horizontal direction, the read-out gray scale value is increased, and the density of a row area is increased in printing. On the other hand, toward the left side, the read-out gray scale value is decreased, and the density of a row area is decreased in printing. The read-out gray scale values are not constant but scattered regardless of forming the band-shaped pattern by using each nozzle based on the predetermined directed gray scale value. This causes the non-uniformity of density.

The correction patterns printed in the first sheet P1 are simultaneously read out by the scanner. However, there is a level difference in a boundary line between a read-out gray scale value (hereinafter, referred to as a read-out gray scale value of the first head) of the correction pattern that is formed by the first head 31(1) and a read-out gray scale value (hereinafter, referred to as a read-out gray scale value of the second head) of the correction pattern that is formed by the second head 31(2). The read-out gray scale value of the first head tends to be lower than the read-out gray scale value of the second head. This is a variation of the read-out gray scale value that is generated due to a characteristic difference of the heads 31. Accordingly, for example, in order to suppress non-uniformity of density of an image formed by the first head 31(1) and the second head 31(2), a correction value for which an image printed by the first head 31(1) is printed thick and an image printed by the second print head 31(2) is printed thin may be calculated.

Similarly, the correction patterns printed on the second sheet P2 are simultaneously read out by the scanner. However, there is a level difference in a boundary line between a read-out gray scale value of a third head and a read-out gray scale value of a fourth head. This is caused by a characteristic difference of the heads 31, and it is known that an image printed by the third head 31(3) is thinner than an image printed by the fourth head 31(4).

In addition, there is also a level difference in the boundary line between the read-out gray scale value of the second head and the read-out gray scale value of third head. However, a correction pattern formed by the second head 31(2) and a correction pattern formed by the third head 31(3) are printed on different sheets P1 and P2 and are not simultaneously read out by the scanner. In addition, the scanner may have an error in the result of read-out due to a use condition and the like. In addition, a read-out error of the scanner may be generated for a case where the sheet P1 is read out by the scanner and a case where the sheet P2 is read out by the scanner.

Accordingly, a difference between the read-out gray scale value of the first head and the read-out gray scale value of the second head and a difference between the read-out gray scale value of the third head and the read-out gray scale value of the fourth head which are simultaneously read by the scanner can be determined as differences due to characteristic differences of heads. However, whether a difference between the read-out gray scale value of the second head (or the read-out gray scale value of the first head) and the read-out gray scale value of the third head (or the read-out gray scale value of the fourth head) that are not simultaneously read out by the scanner is due to a characteristic difference of heads or due to a read-out error of the scanner cannot be determined.

In other words, in the comparative example, a head 31 (or a nozzle) that is used for printing a correction pattern on one sheet P1 is not used for printing a correction pattern on the other sheet P2. Thus, it cannot be determined whether a read-out error of the scanner is generated between the read-out result of one sheet P1 and the read-out result of the other sheet P2. Accordingly, when test patterns are printed, same as in the comparative example, a read-out error of the scanner between read-out results of correction patterns that are not simultaneously read out by the scanner cannot be corrected.

When a correction value is calculated based on the read-out result (the read-out gray scale value) in which a read-out error of the scanner is not relieved, non-uniformity of density cannot be suppressed. For example, in the read-out result shown in FIG. 8, a result in which a correction pattern of the second head 31(2) is printed thicker than that of the third head 31(3) is acquired. Thus, a correction value is calculated such that an image printed by the second head 31(2) is thin, and an image printed by the third head 31(3) is thick. Accordingly, when the difference between the read-out gray scale value of the second head and the read-out gray scale value of the third head is due to not the characteristic difference of heads but a read-out error of the scanner, the image printed by the second head 31(2) becomes too thin, and the image printed by the third head 31(3) becomes too thick. Therefore, the non-uniformity of density deteriorates.

The object of this embodiment is to calculate a correction value of a printer that prints a sheet of a size larger than the read-out range of a scanner, that is, a printer having a long head more accurately. Next, a method of printing a test pattern according to this embodiment will be described.

Print Example 1 of Test Pattern

Figure 9:
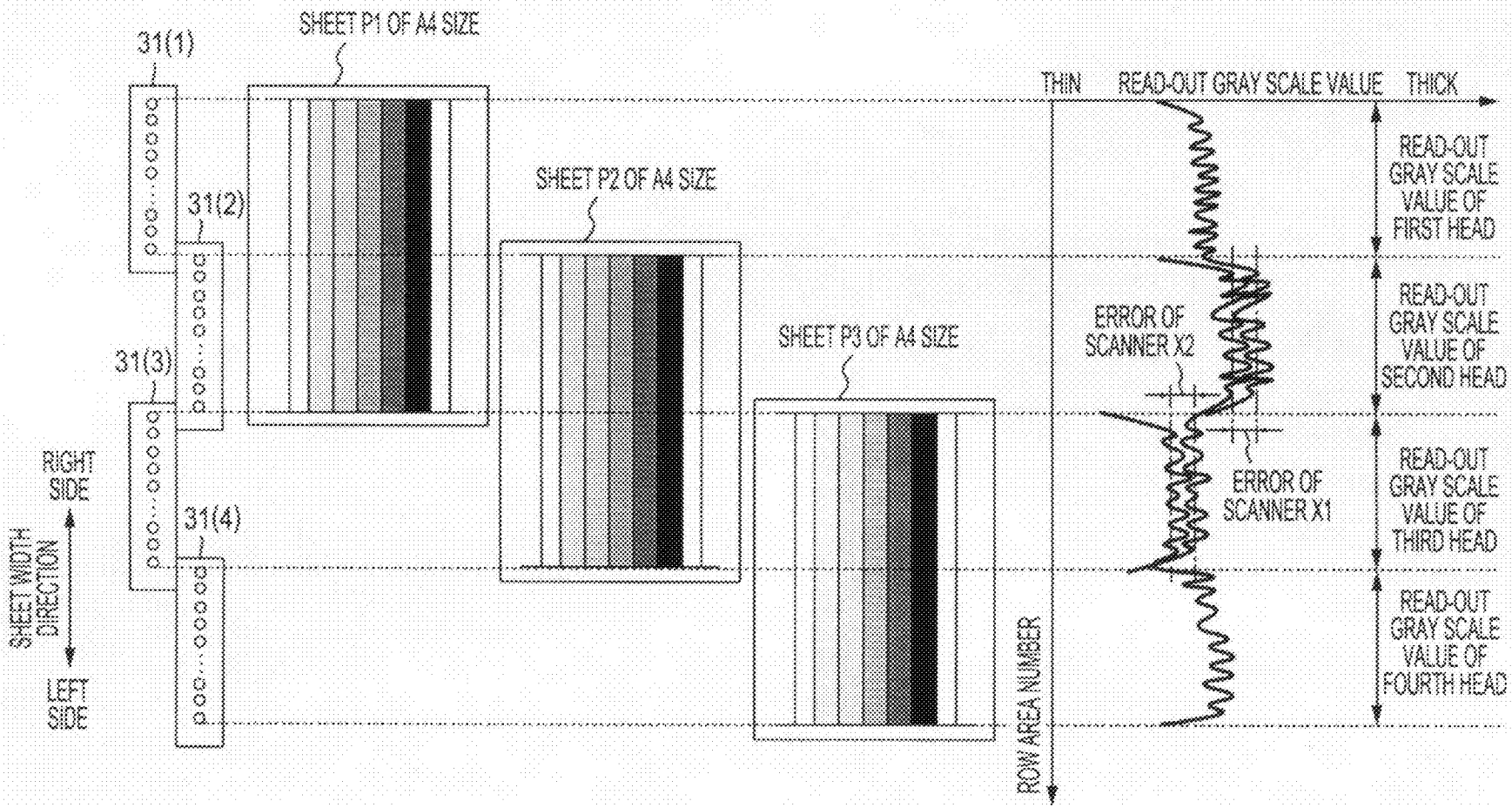
FIG. 9 is a diagram showing a print example 1 of a test pattern and a read-out result.
Figure 10:
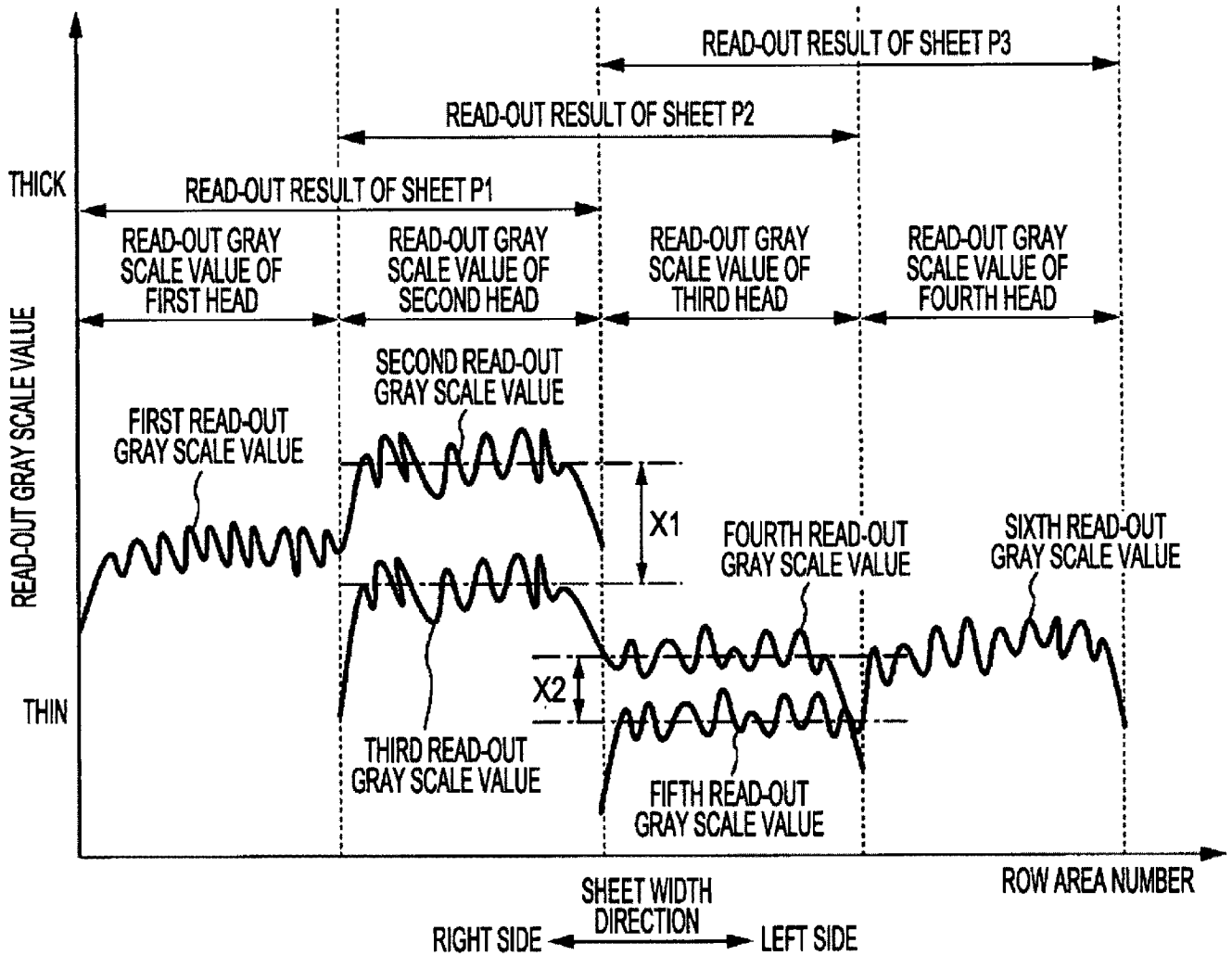
FIG. 10 is an enlarged diagram of the read-out result.

FIG. 9 is a diagram showing a print example 1 of a test pattern according to this embodiment and a read-out result of a band-shaped pattern of a directed gray scale value. FIG. 10 is an enlarged diagram of the read-out result shown in FIG. 9. In the print example 1, a correction pattern (corresponding to a first test pattern) is printed on a sheet P1 of A4 size by the first head 31(1) (corresponding to a first nozzle group) and the second head 31(2) (corresponding to a second nozzle group), a correction pattern (corresponding to a second test pattern) is printed on a sheet P2 of A4 size by the second head 31(2) (corresponding to the second nozzle group) and the third head 31(3) (corresponding to a third nozzle group), and a correction pattern is printed on a sheet P3 of A4 size by the third head 31(3) and the fourth head 31(4). In other words, in the print example 1, correction patterns are printed on two different sheets P1 and P2 by the second head 31(2), and correction patterns are printed on two different sheets P2 and P3 by the third head 31(3). Thereafter, three sheets P1 to P3 are individually read out by the scanner. In the figure, read-out gray scale values of each row area are shown as graphs with a pixel row and a pixel area corresponded as one pair in the image data of which a correction pattern is read out by the scanner.

Here, for description, a read-out result of the correction pattern printed on the sheet P1 by the first head 31(1) is referred to as a "first read-out gray scale value", and a read-out result of the correction pattern printed on the sheet P2 by the second head 31(2) is referred to as a "second read-out gray scale value". In addition, a read-out result of the correction pattern printed on the sheet P2 by the second head 31(2) is referred to as a "third read-out gray scale value", a read-out result of the correction pattern printed on the sheet P2 by the third head 31(3) is referred to as a "fourth read-out gray scale value", a read-out result of the correction pattern printed on the sheet P3 by the third head 31(3) is referred to as a "fifth read-out gray scale value", and a read-out result of the correction pattern printed on the sheet P3 by the fourth head 31(4) is referred to as a "sixth read-out gray scale value".

As shown in FIG. 10, the second head 31(2) and the third head 31(3) print the correction patterns on two sheets, respectively, and whereby two read-out gray scale values are acquired for one row area. Even a same correction pattern is printed by the second head 31(2), the second read-out gray scale value is thicker than the third read-out gray scale value as a read-out result. A difference between the second read-out gray scale value and the third read-out gray scale value is determined to be due to not a characteristic difference of the heads but a read-out error of the scanner. As described above, when different read-out gray scale values are acquired from images printed based on a same directed gray scale value by a same head 31, it can be determined that a read-out error of the scanner occurs. In other words, the difference between the second read-out gray scale value and the third read-out gray scale value is a read-out error X1 of the scanner for cases where the sheets P1 and P2 are read out. Similarly, a difference between the fourth read-out gray scale value and the fifth read-out gray scale value is a read-out error X2 of the scanner for cases where the sheets P2 and P3 are read out.

According to this embodiment, a part or the whole of the read-out results of the correction patterns is corrected (at least one between the first test pattern and the second test pattern is corrected) based on the difference X1 between the second read-out gray scale value and the third read-out gray scale value and the difference X2 between the fourth read-out gray scale value and the fifth read-out gray scale value, and whereby the first read-out gray scale value to the sixth read-out gray scale value are converted into "corrected read-out gray scale values" from which read-out errors of the scanner are resolved. Then, the correction values H are calculated based on the corrected read-out gray scale values.

Figure 11:
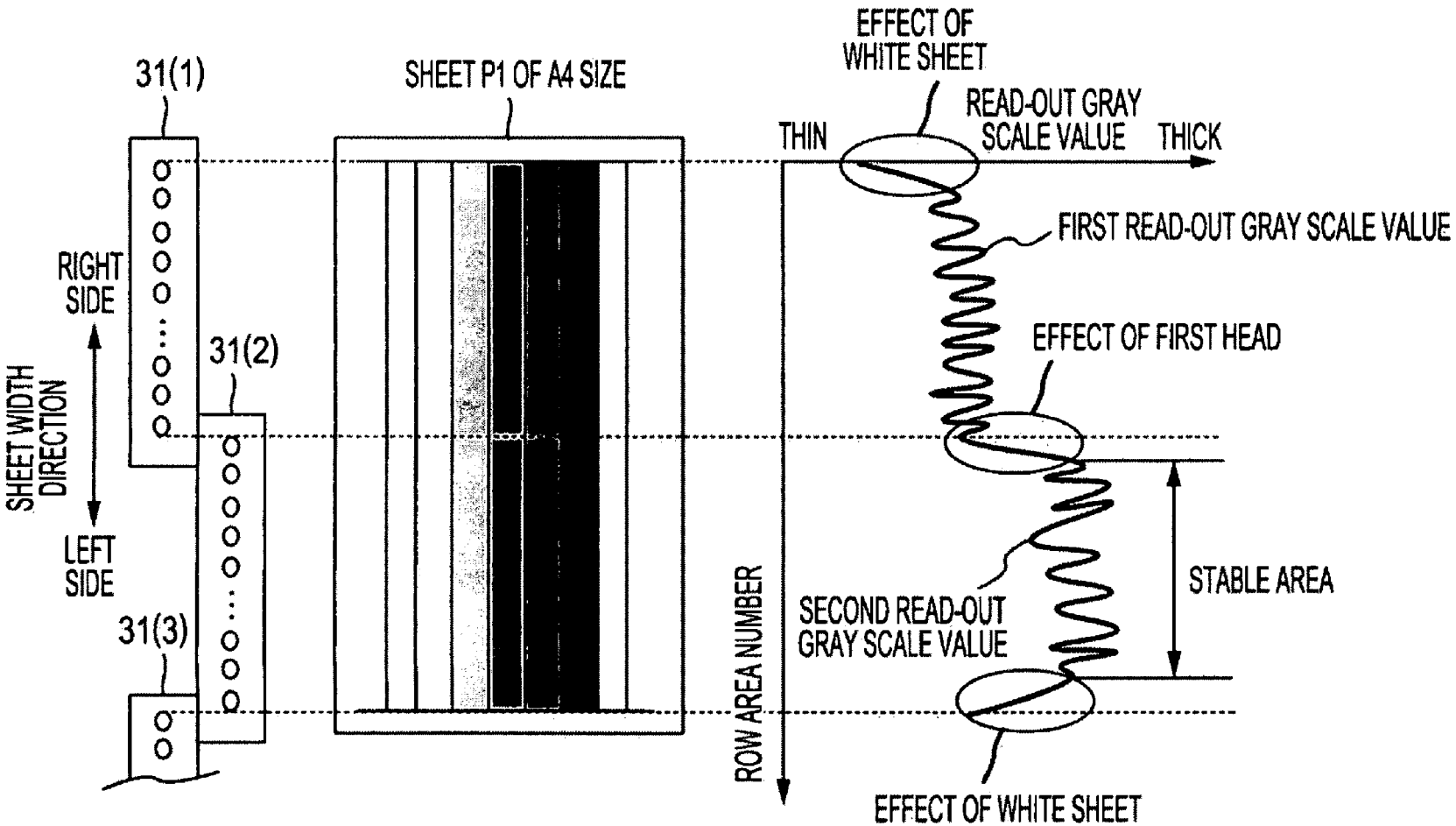
FIG. 11 is a diagram showing a stable area.

FIG. 11 is a diagram showing a stable area of the second read-out gray scale value at the time of calculating the read-out error X1 of the scanner. The read-out result shown in the figure is a read-out result of a correction pattern printed on the sheet P1. Since there is a characteristic difference of the first head 31(1) and the second head 31(2), a level difference is generated in a boundary line between the first read-out gray scale value and the second read-out gray scale value. Accordingly, in a boundary line portion of the first read-out gray scale value and the second read-out gray scale value, the read-out result may not be stable due to influence therebetween. In other words, among the second read-out gray scale values, the read-out result of the correction pattern that is printed by a nozzle located in an end portion of the second head 31(2) on the right side in the sheet width direction may be influenced by the correction pattern that is printed by the first head 31(1). Thus, for calculating the read-out error X1 of the scanner, the read-out gray scale value of the correction pattern formed by the nozzle of the second head 31(2) that is located in the end portion on the right side is not used (the read-out result formed by the nozzle of the second nozzle group that is located in the end portion on one side is excluded).

In addition, when the sheet on which the correction pattern is printed is white, among the second read-out gray scale values, the read-out result of the correction pattern printed by the nozzle of the second head 31(2) that is located on a left end portion in the sheet width direction may be influenced by a white background portion of the sheet (the background color of the sheet) so as to be read out thinner than the actual density thereof. Thus, for calculating the read-out error X1 of the scanner, the read-out gray scale value of the correction pattern formed by the nozzle of the second head 31(2) located in the left end portion is not used (the read-out result formed by the nozzle of the second nozzle group that is located in the end portion on the other side is excluded).

In other words, the read-out results of the correction patterns formed by nozzles of the second head 31(2) other than the nozzles located in the both end portions can be stated as stable data. Thus, the second read-out gray scale values of the row area corresponding to the nozzles of the second head 31(2) other than the nozzles on both end portions are the second read-out gray scale values that belong to the stable area. Then, an average value of the second read-out gray scale values belonging to the stable area is calculated, and the average value becomes an "average value of the second read-out gray scale value".

In addition, as shown in FIG. 10, among the third read-out gray scale values, the read-out result of the correction pattern formed by the nozzle of the second head 31(2) that is located in the right end portion may be influenced by the white background of the sheet, and the read-out result of the correction pattern formed by the nozzle of the second head 31(2) that is located in the left end portion may be influenced by the third head 31(3). Accordingly, an average value of the third read-out gray scale values of the row areas corresponding to the nozzles of the second head 31(2) other than the nozzles located in both end portions is calculated as an "average value of the third read-out gray scale values". In addition, in a case where the average value is calculated with the read-out result that may be influenced by the white background or the read-out result that may be influenced by other heads excluded, the read-out error of the scanner can be corrected more accurately. However, the average value may be calculated with such read-out results included.

Then, a difference between the average value of the second read-out gray scale values and the average value of the third read-out gray scale values is referred to as a "read-out error X1 of the scanner". The read-out result of the sheet P1 and the read out result of the sheet P2 are corrected based on the "read-out error X1 of the scanner".

Similarly, an average value of stable read-out results among the fourth read-out gray scale values is calculated as an "average value of the fourth read-out results, and an average value of stable read-out results among the fifth read-out gray scale values is calculated as an "average value of the fifth read-out results. Then, a difference between the average value of the fourth read-out gray scale values and the average value of the fifth read-out gray scale values is referred to as a "read-out error X2 of the scanner". The read-out result of the sheet P2 and the read-out result of the sheet P3 are corrected based on the "read-out error X2 of the scanner.

As described above, by repeatedly printing the correction patterns on other sheets P1 to P3 (that is, sheets that are not simultaneously read out by the scanner) by using the same heads 31(2) and 31(3), the read-out error of the scanner can be calculated. Next, a method of calculating a "corrected read-out gray scale value", in which the read-out error of the scanner is resolved, based on the read-out result of the correction pattern will be described.

Figure 12A:
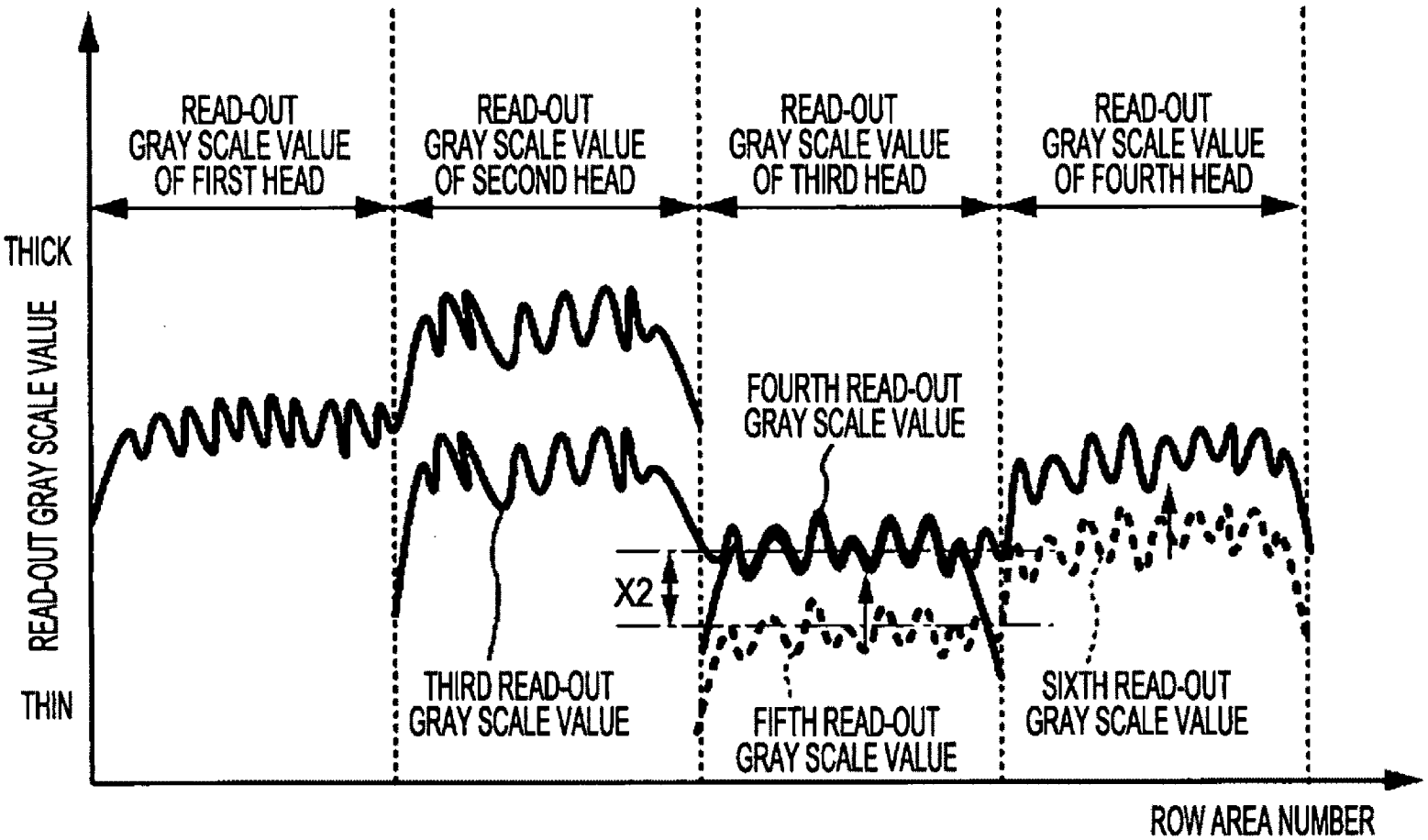
FIGS. 12A and 12B are diagrams showing the appearance of correcting the read-out result.

FIG. 12A is a diagram showing the appearance of correcting the read-out result (the fifth read-out gray scale value and the sixth read-out gray scale value) of the sheet P3 based on the read-out error X2 of the scanner. The read-out result of the sheet P3 is visually recognized thinner than the read-out result (the third read-out gray scale value and the fourth read-out gray scale value) of the sheet P2 due to the read-out error of the scanner by the read-out error X2 of the scanner. Thus, the read-out result (dotted line) of the sheet P3 is corrected to gray scale value (solid line) that is increased by the read-out error X2 of the scanner with the read-out result of the sheet P2 used as the reference. As a result, the fourth read-out gray scale value and the fifth read-out gray scale value that are the read-out results of the correction patterns printed by the third head 31(3) become almost equivalent to each other. Accordingly, the read-out error of the scanner for cases where the sheets P2 and P3 are read out by the scanner is resolved.

Figure 12B:
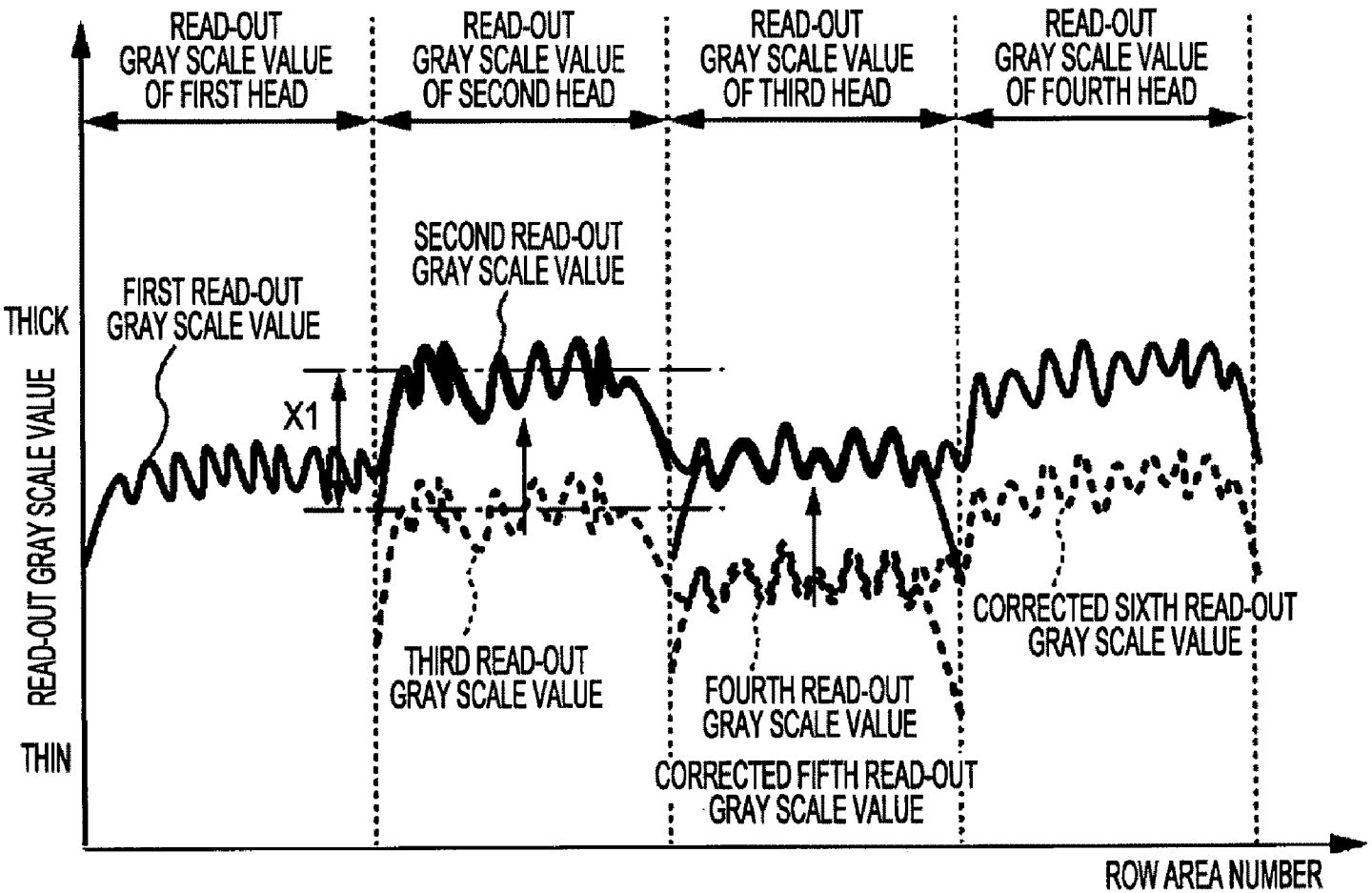

FIG. 12B is a diagram showing the appearance of correcting the read-out result of the sheet P2 and the read-out result of the corrected sheet P3 based on the read-out error X1 of the scanner. The read-out result of the sheet P2 (the third read-out gray scale value and the fourth read-out gray scale value) and the corrected read-out result of the sheet P3 (the fifth read-out gray scale value and the sixth read-out gray scale value) are visually recognized thinner than the read-out result of the sheet P1 (the first read-out gray scale value and the second read-out gray scale value) by the read-out error X1 of the scanner. Thus, the read-out result of the sheet P2 and the corrected read-out result (dotted line) of the sheet P3 are corrected to gray scale values (solid line) that are increased by the read-out error X2 of the scanner with the read-out result of the sheet P1 used as the reference (the fourth read-out gray scale value is corrected by a difference between the second read-out gray scale value and the third read-out gray scale value). As a result, the second read-out gray scale value and the third read-out gray scale value that are the read-out results of the correction patterns printed by the second head 31(2) become almost equivalent to each other. Accordingly, the read-out error of the scanner for a case where the sheet P1 is read out by the scanner and a case where sheets P2 and P3 are read out by the scanner is resolved.

Figure 12C:
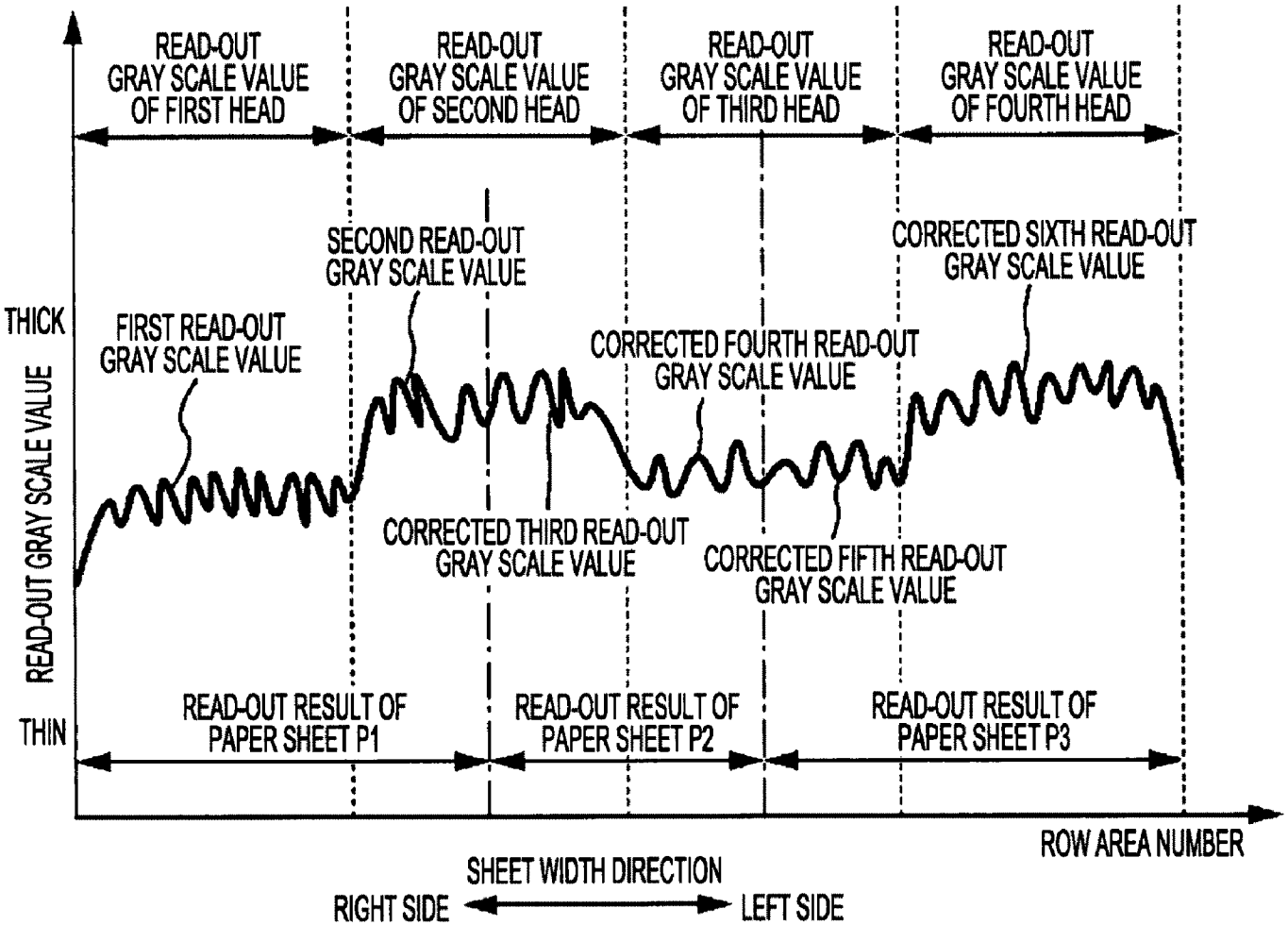
FIG. 12C is a diagram showing a corrected read-out gray scale value.

FIG. 12C is a diagram showing corrected gray scale values in which the read-out error of the scanner is resolved. As shown in FIG. 12B, the read-out gray scale value of the first head and the read-out gray scale value of the fourth head have one data value, respectively. However, the read-out gray scale value of the second head and the read-out gray scale value of the third head have two data values, respectively. Since the read-out error of the scanner is resolved, the read-out gray scale values of the correction patterns printed by a same head 31 represent almost equivalent values with some error. In other words, two read-out gray scale values for each same row area can be acquired, and thus, one read-out gray scale value is selected for calculating the correction value H for each row area. In addition, the read-out gray scale value of the first head and the read-out gray scale value of the fourth head respectively have one data value, and accordingly, the correction value H is calculated by using the first read-out gray scale value and the corrected sixth read-out gray scale value.

As shown in FIG. 11 described above, the read-out result of the row area close to the margin portion of the sheet may be read out to be thinner than the actual density thereof due to the influence of the white background of the sheet. Thus, the read-out gray scale value of the second head and the read-out gray scale value of the third head respectively have two read-out results, and accordingly, it is preferable that the read-out result that is not influenced by the white background of the sheet is selected.

Among the read-out gray scale values of the second head, the read-out result of the second read-out gray scale value for the third head 31(3) side may be influenced by the white background of the sheet, and the read-out result of the corrected third read-out gray scale value for the first head 31(1) side may be influenced by the white background of the sheet. Thus, the read-out result of the row area corresponding to the nozzle located on the first head 31(1) side (the right side in the sheet width direction) of the second head 31(2) relative to the center portion, that is, the second read-out gray scale value (the read-out result of the sheet P1) is selected. In addition, it is preferable that the read-out result of the row area corresponding to the nozzle located on the third head 31(3) side (the left side in the sheet width direction) of the second head 31(2) relative to the center portion, that is, the corrected third read-out gray scale value (the read-out result of the sheet P2) is selected.

Similarly, the read-out result of the row area corresponding to the nozzle located on the second head 31(2) side (the right side in the sheet width direction) of the third head 31(3) relative to the center portion, that is, the corrected fourth gray scale value (the read-out result of the sheet P2) is selected. In addition, it is preferable that the read-out result of the row area corresponding to the nozzle located on the fourth head 31(4) side (the left side in the sheet width direction) of the third head 31(3) relative to the center portion, that is, the corrected fifth read-out gray scale value (the read-out result of the sheet P3) is selected.

The read-out result influenced by the white background of the sheet is read out to be thinner than its actual density. Thus, when the correction value H is calculated by selecting the read-out result influenced by the white background of the sheet, the row area thereof may be printed too thick. Accordingly, by not selecting the read-out result that may be influenced by the white background of the sheet as possibly, the correction value H can be calculated more accurately. Thereby non-uniformity of the density can be suppressed. The invention is not limited thereto, and the read-out result that may be influenced by the white background of the sheet may be selected.

To sum up the description as above, as shown in FIG. 12C, the corrected read-out gray scale value corresponding to the first head 31(1) is the first read-out gray scale value, the corrected read-out gray scale value corresponding to the right half of the second head 31(2) is the right half of the second read-out gray scale value, and the corrected read-out gray scale value corresponding to the left half of the second head 31(2) is the left half of the corrected third read-out gray scale value. In addition, the corrected read-out gray scale value corresponding to the right half of the third head 31(3) is the right half of the corrected fourth read-out gray scale value, the corrected read-out gray scale value corresponding to the left half of the third head 31(3) is the left half of the corrected fifth read-out gray scale value, and the corrected read-out gray scale value corresponding to the fourth head 31(4) is the corrected sixth read-out gray scale value. The corrected read-out gray scale value is configured by the read-out gray scale values of the row areas. In this corrected read-out gray scale value, variations of the read-out gray scale values due to the characteristic difference of heads and the characteristic difference of nozzles are included. However, variations of the read-out gray scale values due to the read-out error of the scanner are not included. Thus, by calculating the correction value H for each row area based on the "corrected read-out gray scale value", the correction value H can be calculated more accurately.

In addition, in FIGS. 12A and 12B, for the description, all the third read-out gray scale value to the sixth read-out gray scale value are corrected. However, when a read-out gray scale value used for calculating the correction value H is determined in advance, it is preferable that only the read-out gray scale value is corrected in accordance with the read-out error of the scanner. For example, the read-out gray scale value of the third read-out gray scale values for the first head 31(1) side relative to the center portion is not used for calculating the correction value H, and accordingly, it is preferable that such a read-out gray scale value is not corrected. In addition, only the read-out gray scale value among the third read-out gray scale values for the third head 31(3) side relative to the center portion is corrected to a gray scale value increased by the read-out error X1 of the scanner. In such a case, a process for correcting the read-out gray scale value can be shortened.

Figure 13:
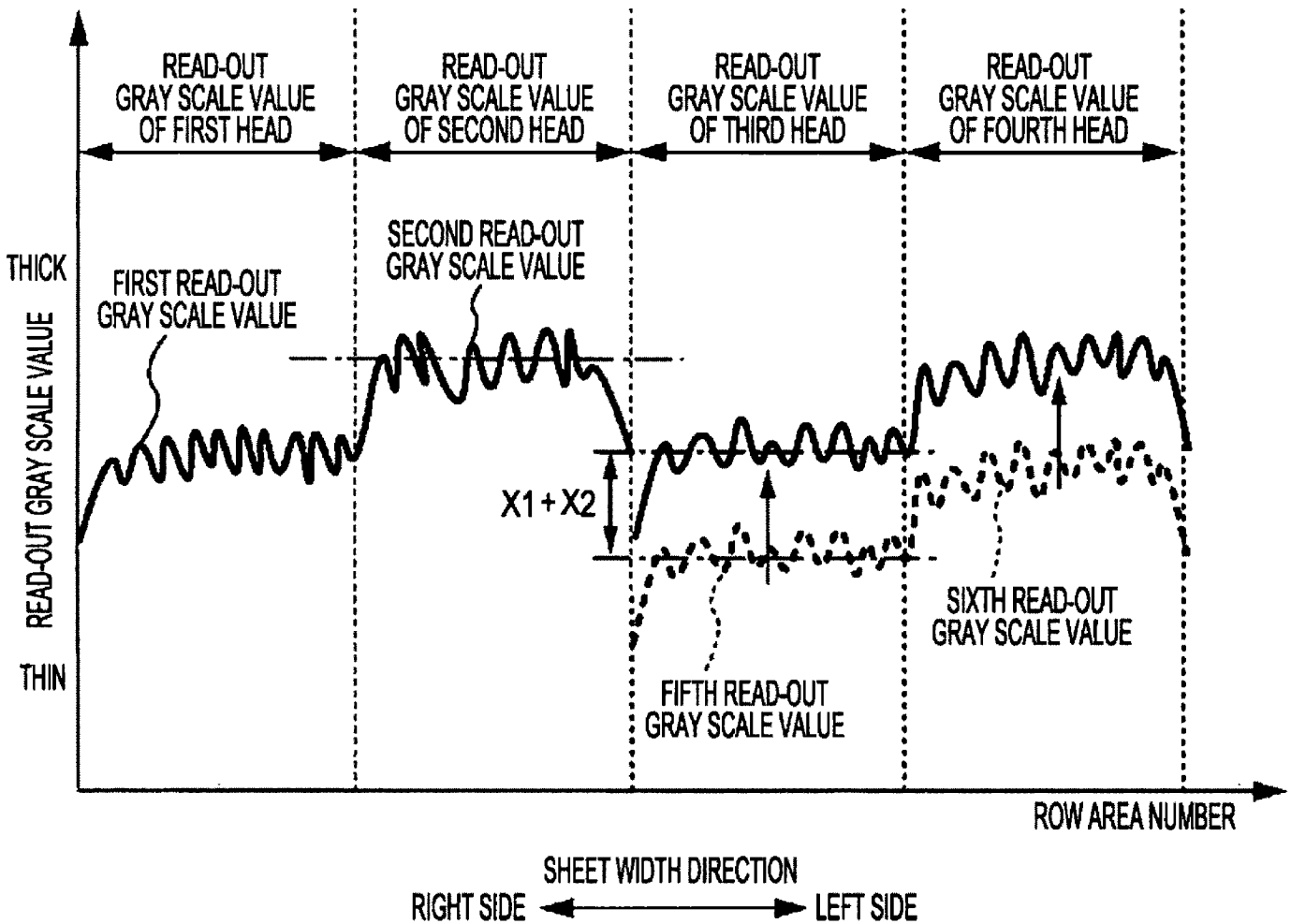
FIG. 13 is a diagram showing the appearance of correcting the read-out result.

FIG. 13 is a diagram showing the appearance of correcting the read-out result of the sheet P3 with the read-out result of the sheet P1 used as the reference. In FIGS. 12A to 12C, both the read-out result of the sheet P2 and the read-out result of the sheet P3 are corrected with the read-out result of the sheet P1 used as the reference. However, the invention is not limited thereto. For example, as shown in FIG. 13, only the read-out result (the fifth read-out gray scale value and the sixth read-out gray scale value) of the sheet P3 may be configured to be corrected. It can be known that the read-out error of the scanner for a case where the sheet P1 is read out by the scanner and a case where the sheet P3 is read out by the scanner is "X1+X2" based on the difference X1 between the second read-out gray scale value and the third read-out gray scale value and the difference X2 between the fourth read-out gray scale value and the fifth read-out gray scale value. Thus, it may be configured that the read-out result of the sheet P3 is corrected by the read-out error "X1+X2" of the scanner, and the correction value H for each row area is calculated by using the read-out result of sheet P1 and the corrected read-out result of the sheet P3 as the "corrected read-out gray scale value". In other words, the correction result of the sheet P2 is not used for calculating the correction value H but used for calculating the read-out error of the scanner. Accordingly, the process for correcting the read-out gray scale value based on the read-out error of the scanner can be shortened.

Figure 14A:
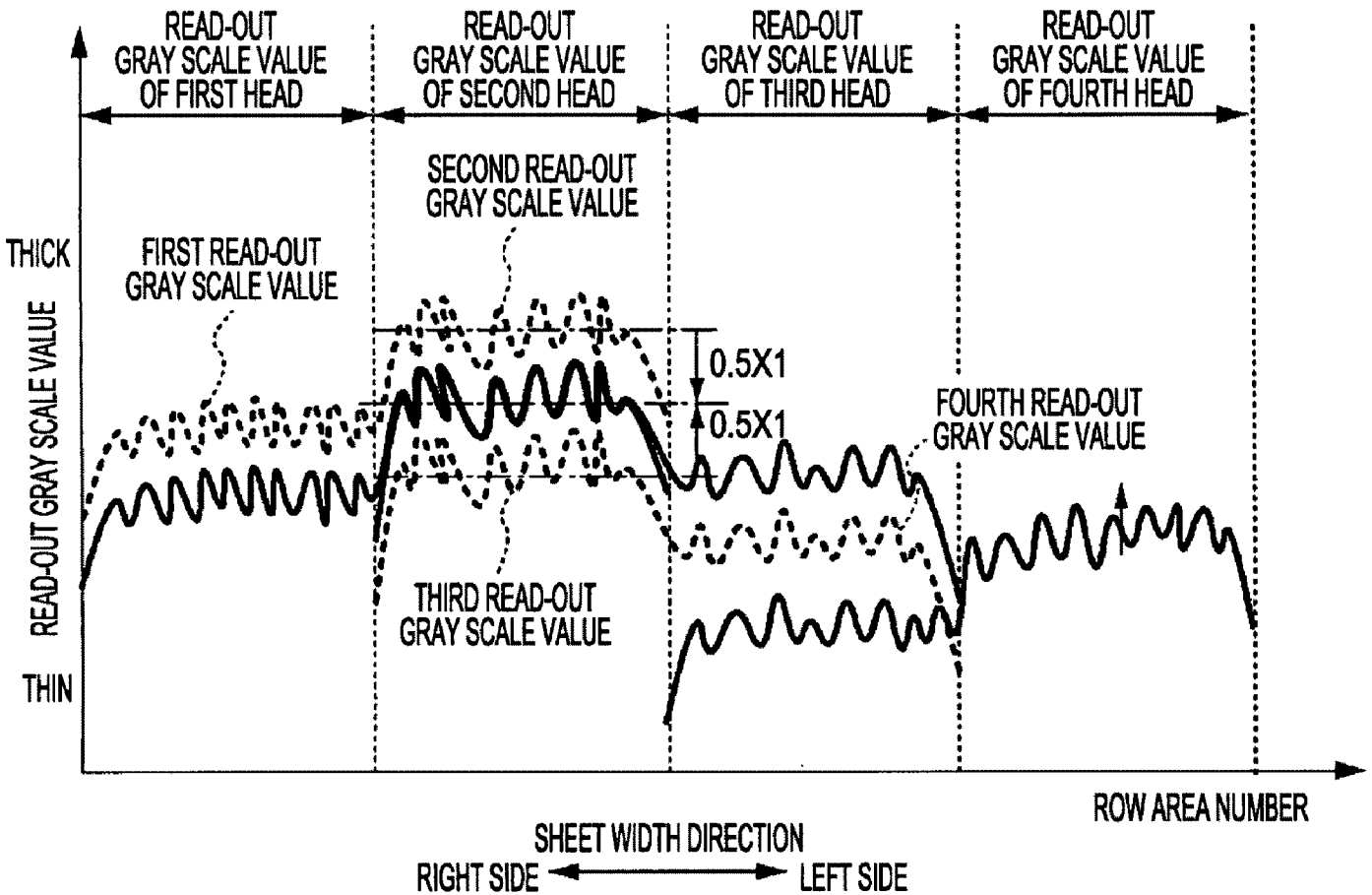
FIGS. 14A and 14B are diagrams showing the appearance of correcting the read-out result.

FIG. 14A is a diagram showing the appearance of correcting the read-out result of the sheet P1 and the read-out result of the sheet P2 based on the read-out error X1 of the scanner. In FIGS. 12A to 12C and 13, the read-out results of other sheets P2 and P3 are corrected with the read-out result of the sheet P1 used as the reference. However, the invention is not limited thereto. For example, as shown in FIG. 14A, the read-out results of both the sheets P1 and P2 may be configured to be corrected. The read-out result of the sheet P1 has a gray scale value larger than that of the sheet P2 by the read-out error X1 of the scanner. Accordingly, the read-out result of the sheet P1 (the first read-out gray scale value and the second read-out gray scale value) is corrected to a gray scale value decreased by a half (0.5 X1) of the read-out error X1 of the scanner, and the read-out result of the sheet P2 (the third read-out gray scale value and the fourth read-out gray scale value) to a gray scale value increased by the a half (0.5X1) of the read-out error X1 of the scanner. As a result, the second read-out gray scale value and the third read-out gray scale value that are the read-out results of the correction patterns printed by the second head 31(2) become almost equivalent to each other, and accordingly, the read-out error of the scanner for a case where the sheet P1 is read out by the scanner and a case where the sheet P2 is read out by the scanner is resolved. In addition, the invention is not limited to correct by a value corresponding to a half of the read-out error X1 of the scanner. Thus, it may be configured that the read-out result of the sheet P1 is corrected by a part of the read-out error X1 of the scanner, and the read-out result of the sheet P2 is corrected by a remaining part of the read-out error X1 of the scanner from which the part is excluded.

Figure 14B:
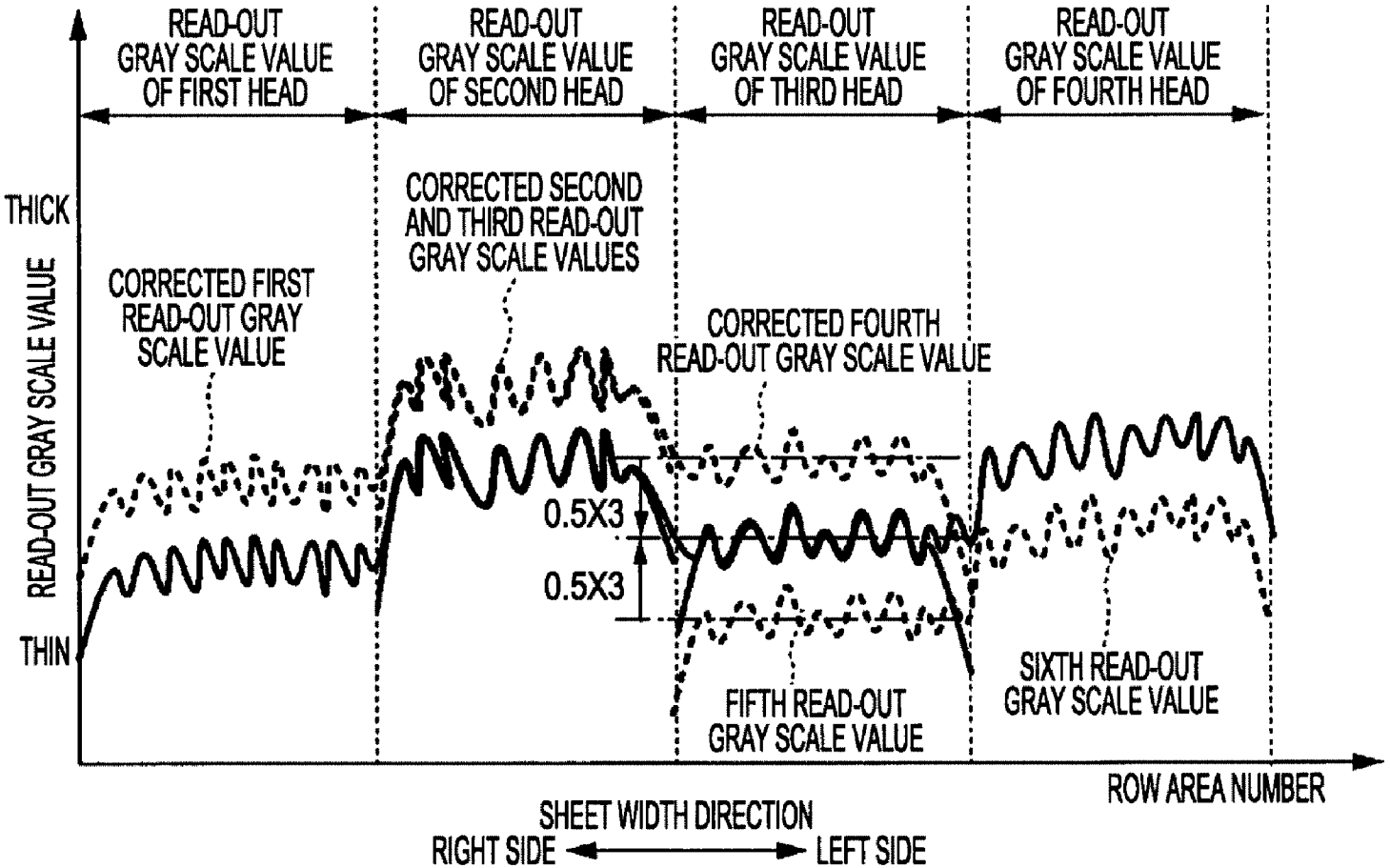

FIG. 14B is a diagram showing the appearance of the read-out results of the corrected sheets P1 and P2 and correcting the read-out result of the sheet P3, based on the read-out error X3 of the scanner. Next, by having the corrected fourth read-out gray scale value and the fifth read-out gray scale value to be equivalent, the read-out error of the scanner is resolved. The corrected fourth read-out gray scale value is a gray scale value larger than the fifth read-out gray scale value by the read-out error X3 of the scanner. Thus, the fourth read-out gray scale value is further corrected to a gray scale value decreased by a value (0.5 X3) corresponding to a half of the read-out error X3 of the scanner from the corrected first read-out gray scale value, and the fifth read-out gray scale value and the sixth gray scale value are corrected to gray scale values increased by a value (0.5 X3) corresponding to a half of the read-out error X3 of the scanner. As a result, the corrected fourth read-out gray scale value and the corrected fifth read-out gray scale value become almost equivalent, and thereby the read-out error of the scanner is resolved.

Thereafter, the read-out gray scale value for the second head and the read-out gray scale value for the third head have two read-out gray scale values for each row area, respectively. Thus, it is preferable that the "corrected read-out gray scale value" that is finally configured by one read-out gray scale value corresponding to each row area is calculated by selecting a read-out gray scale value that is not influenced by the white background portion of the sheet or the like. In FIGS. 14A and 14B, for the description, all the read-out gray scale values are corrected. However, it is preferable that only used read-out gray scale values are corrected.

In FIGS. 12A to 12C and 13, the read-out results of other sheets P2 and P3 are corrected with the read-out result of the sheet P1 used as the reference. However, it does not mean that the read-out result of the sheet P1 is a correct read-out result. Accordingly, as shown in FIGS. 14A and 14B, the read-out results of both sheets may be corrected by a value corresponding to a half of the read-out error of the scanner, or the read-out results of other sheets P1 and P2 may be corrected with the result of the sheet P3 used as the reference. The main point is that it is preferable to resolve the read-out error of the scanner acquired by printing the correction patters for a same head on two sheets not simultaneously read out by the scanner from the read-out results. In the "corrected read-out gray scale value" acquired as described above, not variations of the read-out gray scale values due to the read-out error of the scanner but variations of the read-out gray scale values due to characteristic differences of the heads and the nozzles are included. Accordingly, by calculating the correction value H based on the corrected read-out gray scale value, non-uniformity of density occurring due to the characteristic differences of the head and the nozzles can be suppressed.

In addition, in the comparative example (FIG. 8), the sheets P1 and P2 are fed with being deviated from each other by a length of two heads 31 in the sheet width direction, and the correction patterns are printed thereon. On the other hand, in the print example 1 (FIG. 9), the sheets P1 to P3 are fed with being deviated with one another by a length of one head 31 in the sheet width direction. Accordingly, in the print example 1, three boundary lines of four heads 31(1) to 31(4) are printed in the center portion of a same sheet all the time. In particular, a boundary line of the first head 31(1) and the second head 31(2) is printed in the center portion of the sheet P1, a boundary line of the second head 31(2) and the third head 31(3) is printed in the center portion of the sheet P2, and a boundary line of the third head 31(3) and the fourth head 31(4) is printed in the center portion of the sheet P3.

In the read-out result of the correction pattern printed in the boundary line portion of the heads 31, a level difference due to a characteristic difference of heads is generated. For example, as shown in FIG. 10, the second read-out gray scale value is larger than the first read-out gray scale value. Thus, an image printed by the first head 31(1) is visually recognized relatively to be thin, and an image printed by the second head 31(2) is visually recognized relatively to be thick. When these images are adjacently located without any density correction, the boundary line portion becomes a stripe. Accordingly, the boundary line portion is visually recognized easily and causes deterioration of an image. Therefore, a correction value H of a row area corresponding to the boundary line portion of the heads 31 is needed to be calculated more accurately.

In the comparative example (FIG. 8), a boundary line between the second head 31(2) and the third head 31(3) is printed on different sheets. Thus, a correction value corresponding to the second head 31(2) is calculated based on the read-out result of the sheet P1, and a correction value corresponding to the third head 31(3) is calculated based on the read-out result of the sheet P2. In the read-out results of the sheet P1 and the sheet P2, a read-out error of the scanner is included, and accordingly, the non-uniformity of density cannot be suppressed.

Moreover, a correction pattern printed in the boundary line between the second head 31(2) and the third head 31(3) is adjacent to the margin of the sheet. Thus, the read-out result of the correction pattern printed in the boundary line between the second head 31(2) and the third head 31(3) may be influenced by the white background of the sheet so as to result in a read-out gray scale value of thinner density than the actual density. In such a case, the correction value H of the row area corresponding to the boundary line between the second head 31(2) and the third head 31(3) is not calculated accurately, and, for example, a boundary line between an image printed by the second head 31(2) and an image printed by the third head 31(3) is printed thick, whereby the image quality deteriorates.

In other words, as in the comparative example, when the correction pattern printed in the boundary line of the heads 31 is located adjacent to the margin of the sheet, the correction value H of the row area corresponding to the boundary line of the head 31 cannot be calculated. Thus, as in the print example 1, the correction pattern is printed in the center portion (other than the end portion of the sheet) of the sheet for the boundary line of the heads 31, the read-out result of the correction pattern printed in the boundary line of the head 31 becomes stable, and whereby an accurate correction value H can be calculated. As a result, the boundary line of the image printed by different heads 31 cannot be easily recognized visually, and therefore, a high-quality image can be acquired.

Print Example 2 of Test Pattern

Figure 15:
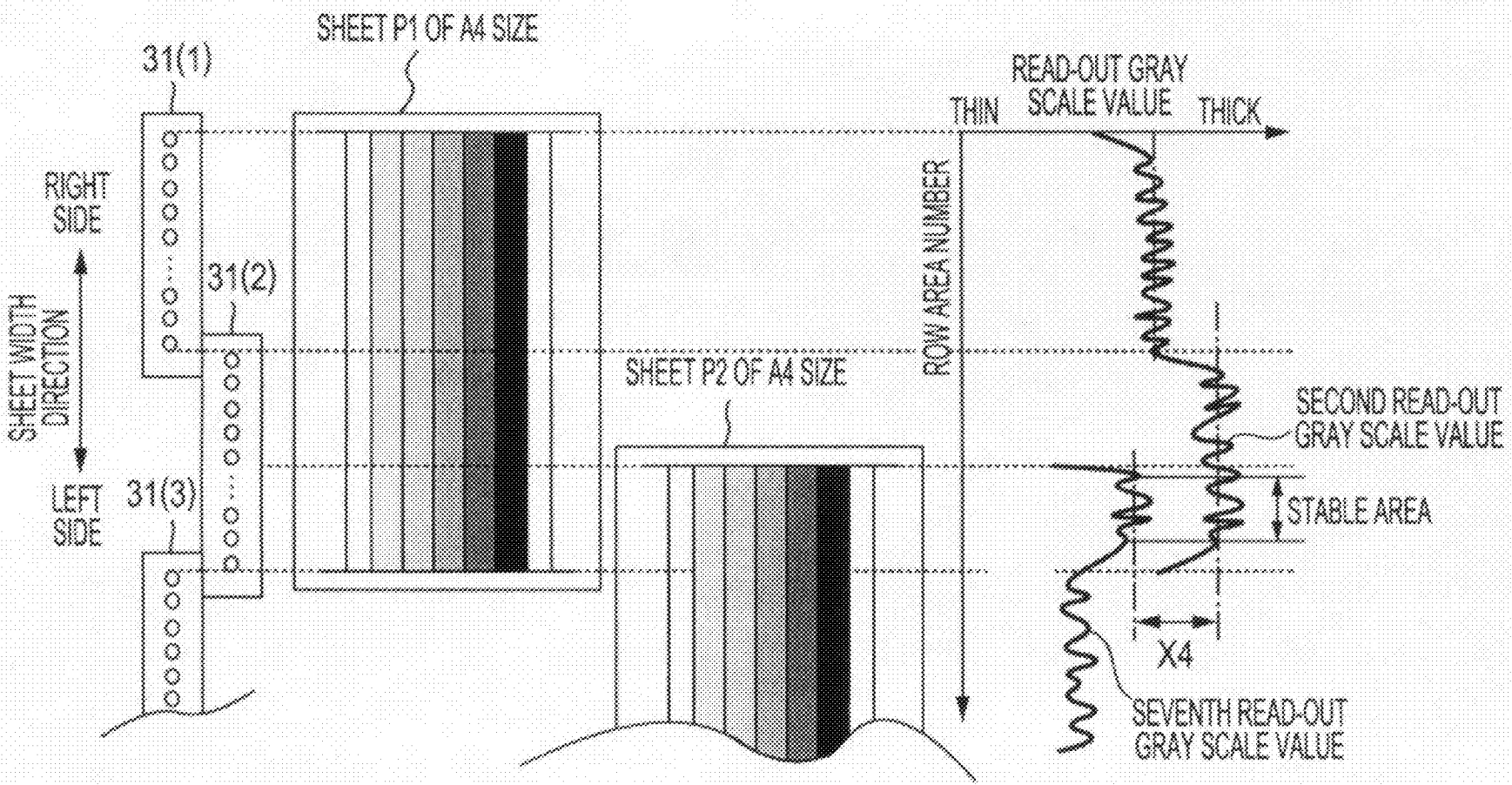
FIG. 15 is a diagram showing a print example 2 of a test pattern.

FIG. 15 is a diagram showing a print example 2 of a test pattern. In the above-described print example 1 (FIG. 9), all the nozzles belonging to the second head 31(2) print the correction patterns on the sheets P1 and P2, and all the nozzles belonging to the third head 31(3) print the correction patterns on the sheets P2 and P3. However, the invention is not limited thereto. When there is at least one nozzle that prints the correction patterns on different sheets, the read-out error of the scanner can be calculated based on the read-out result of a correction pattern printed by the nozzle on one sheet and the read-out result of a correction pattern printed by the nozzle on the other sheet.

However, as also shown in FIG. 11, the read-out result of a row area located near a margin portion of the sheet may be influenced by the white background. Accordingly, it is preferable that the read-out error of the scanner is calculated based on the stable read-out result that is not influenced by the white background of the sheet. Thus, in this print example 2, the correction patterns are printed on the sheets P1 and P2 by using nozzles located in the center portion of the second head 31(2) to a left end portion thereof. The read-out result of the correction pattern printed on the sheet P1 by the second head 31(2) is referred to as a second read-out gray scale value, and the read-out result of the correction patterns printed on the sheet P2 by nozzles located in the center portion of the second head 31(2) to the left end portion thereof is referred to as a "seventh read-out gray scale value".

Among the seventh read-out gray scale values, the read-out gray scale value of a correction pattern that is formed by the nozzle located in the center portion of the second head 31(2) may be influenced by the white background of the sheet. In addition, among the seventh read-out gray scale values, the read-out gray scale value of a correction pattern formed by the nozzle located in the left end portion of the second head 31(2) may be influenced by the third head 31(3). Accordingly, it is preferable that the read-out gray scale value, which may be influenced by the white background of the sheet, are not used for calculating the read-out error of the scanner.

The read-out gray scale values of the correction patterns formed by nozzles other than the nozzles located in the center portion of the second head 31(2) and the left end portion thereof can be determined to be stable data. Thus, an average value of the seventh read-out gray scale values belonging to the stable area shown in the figure is calculated, and the average value is referred to as an "average value of the seventh read-out gray scale values". Similarly, an average value of the second read-out gray scale values belonging to the stable area shown in the figure is calculated as an "average value of the second read-out gray scale values". Then, a difference between the average value of the seventh read-out gray scale values and the average value of the second read-out gray scale values is a read-out error X4 of the scanner for a case where the sheet P1 is read out by the scanner and a case where the sheet P2 is read out by the scanner. It is preferable that the corrected read-out gray scale value is calculated by correcting the read-out gray scale values, as shown in the above-described print example 1 (FIGS. 12A to 14B), based on the read-out error X4 of the scanner calculated as described above.

Accordingly, by calculating the correction value H based on the corrected read-out gray scale value in which the read-out error of the scanner is resolved, the non-uniformity of density can be suppressed. In addition, in the print example 2, the number of nozzles that print the correction patterns on two different sheets is decreased, compared to the print example 1, and accordingly, the consumption amount of ink can be decreased. In addition, a process for calculating the read-out error of the scanner can be performed in an easy manner.

Print Example 3 of Test Pattern

Figure 16A:
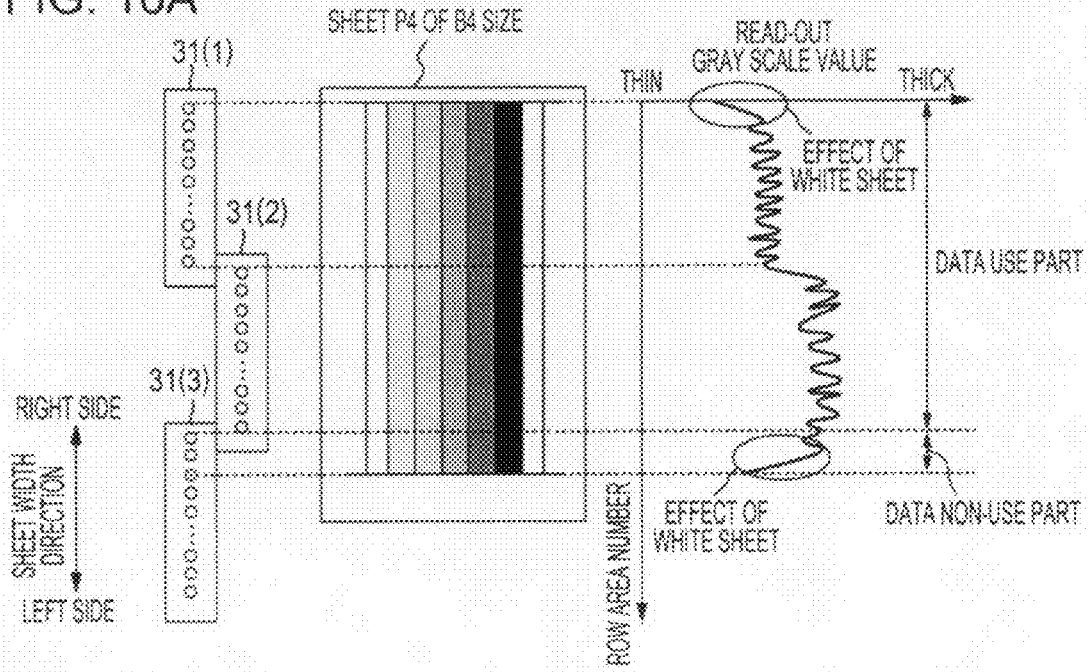
FIGS. 16A and 16B are diagrams showing a print example 3 of a test pattern.
Figure 16B:
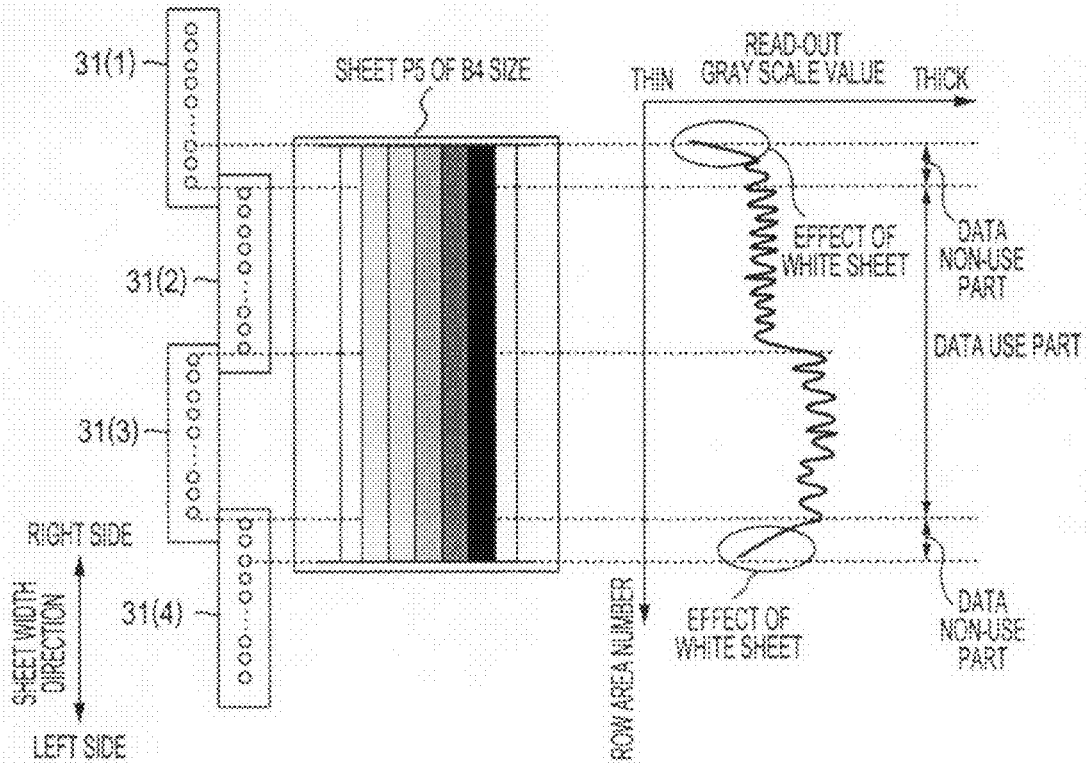

FIGS. 16A and 16B are diagrams showing a print example 3 of a test pattern. In this print example 3, correction patterns are printed on one sheet by using nozzles more than the number of nozzles used for printing the correction patterns on one sheet in the print example 1 (FIG. 9). In other words, in the print example 3, the correction pattern printed on one sheet is increased in size, compared to the correction pattern in the print example 1. Accordingly, in the print example 3, the correction patterns are printed on a sheet of B4 size that is larger than the sheet of A4 size that is used in the print example 1.

For example, in order to acquire a read-out gray scale value of the first head and a read-out gray scale value of the second head, in the print example 1 (FIG. 9), the correction patterns are printed on a first sheet P1 by the first head 31(1) and the second head 31(2). On the other hand, in the print example 3 (FIG. 16A), the correction patterns are printed on a first sheet P4 by the first head 31(1), the second head 31(2), and nozzles that are located in the right end portion of the third head 31(3) (a first test pattern is formed by using the first nozzle group, the second nozzle group, and a nozzle that is located in an end portion of the third nozzle group on one side).

As shown in FIG. 11 described above, the read-out gray scale value of a row area located near the margin portion of the sheet may be influenced by the white background of the sheet so as to be visually recognized to have density thinner than the actual density thereof. Accordingly, in the print example 1 (FIG. 9), the correction patterns formed by nozzles located in the left end portion of the second head 31(2) may be influenced by the white background. On the other hand, in the print example 3 (FIG. 16A), the read-out gray scale value of the correction pattern that is formed by the right end portion of the third head 31(2) may be influenced by the white background. However, the read-out gray scale value of the correction pattern formed by nozzle located in the left end portion of the second head 31(2) is stable data that is not influenced by the white background.

In other words, as in the print example 3, by allowing not only the nozzles (here, the first head 31(1) and the second head 31(2)) of which read-out gray scale values are needed but also nozzles in the vicinity thereof (here, the nozzles located in the right end portion of the third head 31(3)) to print the correction patterns, the influence of the white background of the sheet on the needed data (read-out gray scale value) can be prevented. In other words, among the read-out results shown in FIG. 16A, the read-out gray scale values of the correction patterns formed by the first head 31(1) and the second head 31(2) are used, and the read-out gray scale value of the correction pattern formed by the right end portion of the third head 31(3) is not used.

However, a nozzle located to the right side of the first head 31(1) does not exist. Accordingly, a correction pattern formed by a nozzle that is located in the right end portion of the first head 31(1) is adjacent to the white background portion of the sheet, and accordingly, the correction pattern may be influenced by the white background portion. Similarly, any nozzle does not exist to the left side of the head 31(*n*) (here, the fourth head 31(4)) located on the leftmost side in the sheet width direction.

Thus, for example, preliminary nozzles that are not used for an actual printing operation may be disposed in the right end portion of the first head 31(1) and the left end portion of the fourth head 31(4). In such a case, when a read-out result of a correction pattern of the first head 31(1) or the fourth head 31(4) is needed, a correction pattern is printed by the preliminary nozzle, as well. As a result, it can be prevented that a read-out gray scale value of the correction pattern formed by the nozzle located in the right end portion of the first head 31(1) and a read-out gray scale value of the correction pattern formed by the nozzle located in the left end portion of the fourth head 31(4) are influenced by the white background of the sheet. Therefore, a more accurate correction value H can be calculated. Alternatively, instead of preparing the preliminary nozzles, the degree of influence of the white background portion on a row area located near the white background portion of the sheet may be calculated, and the read-out gray scale values of correction patterns formed by the nozzle located in the right end portion of the first head 31(1) and the nozzle located in the left end portion of the fourth head 31(4) may be corrected.

FIG. 16B shows a correction pattern to be printed for a case where the read-out gray scale value of the second head and the read-out gray scale value of the third head need to be acquired. In such a case, the nozzles located in the left end portion of the first head 31(1), the second head 31(2), the third head 31(3), and the nozzle located in the right end portion of the fourth head 31(4) print the correction patterns. As a result, the read-out gray scale values of the correction patterns that are formed by nozzles located in the left end portion of the first head 31(1) and the nozzles located in the right end portion of the fourth head 31(4) may be influenced by the white background. However, the read-out gray scale value of the second head and the read-out gray scale value of the third head that need to be acquired show stable read-out results that are not influenced by the white background of the sheet. As described above, for heads 31 other than the heads 31(1) and 31(*n*) located on both ends in the sheet width direction, by allowing the nozzles of which the read-out gray scale values need to be acquired and the nozzles in the vicinity thereof to print the correction patterns, the influence of the white background of the sheet on the data (the read-out gray scale values) need to be acquired can be prevented. As a result, the correction value H can be calculated more accurately.

In addition, as shown in FIGS. 16A and 16B, when only stable read-out gray scale values that are not influenced by the white background can be acquired, for example, as in the print example 1 of FIGS. 12A to 12C, for a case where two gray scale values including the second read-out gray scale value and the third read-out gray scale value exist as the read-out gray scale values of the second head, the read-out gray scale value that is not influenced by the white background of the sheet does not need to be used selectively. As a result, any of the second read-out gray scale value or the third read-out gray scale value may be used.

In addition, as shown in the print example 1 of FIG. 13, in a case where only the read-out result (the fifth read-out gray scale value and the sixth read-out gray scale value) of the sheet P3 is corrected for simplifying the process of correcting the read-out gray scale values, when all the read-out results of the sheet P3 are stable read-out gray scale values, the correction value H can be calculated more accurately.

S004: Method of Calculating Correction Value H

As described above, when the corrected read-out gray scale value in which the read-out error of the scanner is relieved is calculated, the correction value H is calculated based on the corrected read-out gray scale value. For example, as shown in FIG. 12C, in order to decrease the non-uniformity in the density for the row areas due to differences of characteristics of the heads and the nozzles, it is preferable that a difference in the density at a same gray scale value is relieved for each row area. In other words, by approaching the density of the row areas to a constant value, the non-uniformity of density is suppressed.

Thus, for a same directed gray scale value, for example, Sb, an average value Cbt of the read-out gray scale values for the whole row areas is set as a "target value Cbt". Then, the gray scale values of pixels corresponding to the row areas are corrected such that the read-out gray scale values for the directed gray scale value Sb approach the target value Cbt.

For an i-row area in which the read-out gray scale value Cbi for the directed gray scale value Sb is smaller than the target value Cbt, the gray scale value is corrected before a half-tone process and a density correcting process such that a printing operation is performed to be thicker than the setting of the directed gray scale value Sb. On the other hand, for a j-row area (Cbj) in which the read-out gray scale value is larger than the target value Cbt, the gray scale value is corrected such that a printing operation is performed to be thinner than the setting of the directed gray scale value Sb.

Figure 17A:
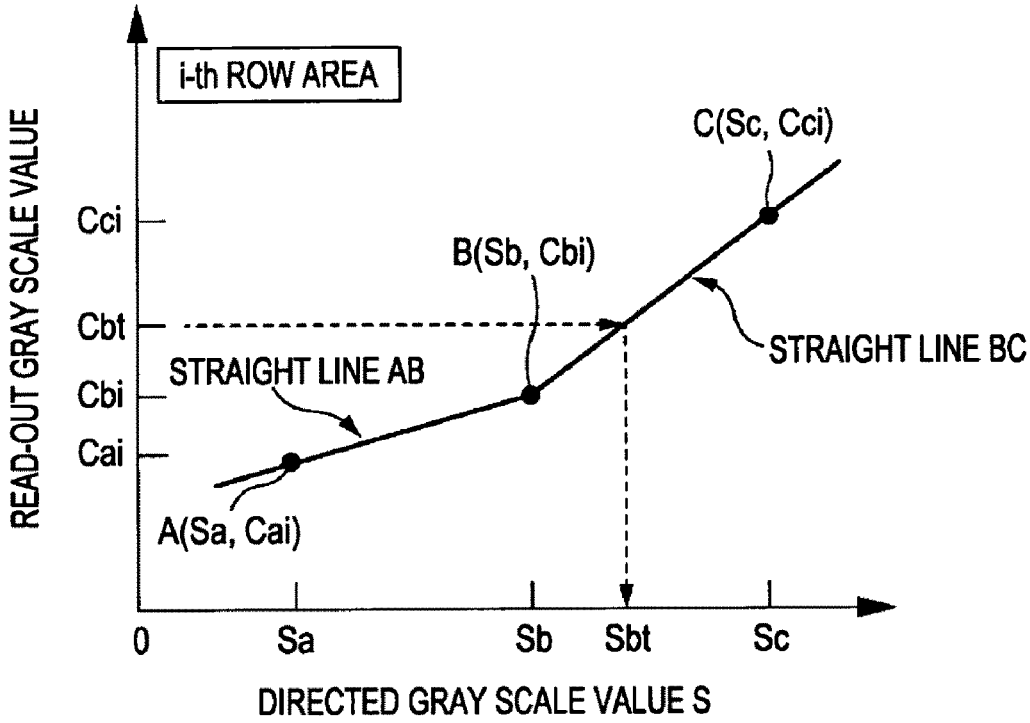
FIGS. 17A and 17B are diagrams showing a method of calculating a target gray scale value.

FIG. 17A is a diagram showing a method of calculating the target gray scale value Sbt for the i-th row area for which the read-out result is smaller than the target gray scale value Cbt. The horizontal axis represents a directed gray scale value, and the vertical axis represents a read-out gray scale value. On the graph, the read-out results (Cai, Cbi, Cci, Cdi, and Cei) of cyan of the i-th row area for the directed gray scale values (Sa, Sb, Sc, Sd, and Se) are plotted. A target directed gray scale value Sbt for the i-th row area represented by the target value Cbt for the directed gray scale value Sb is calculated by using the following equation (linear interpolation on the basis of a straight line BC).

$$Sbt=Sb+(Sc-Sb)\times[(Cbt-Cbi)/(Cci-Cbi)]$$

Figure 17B:
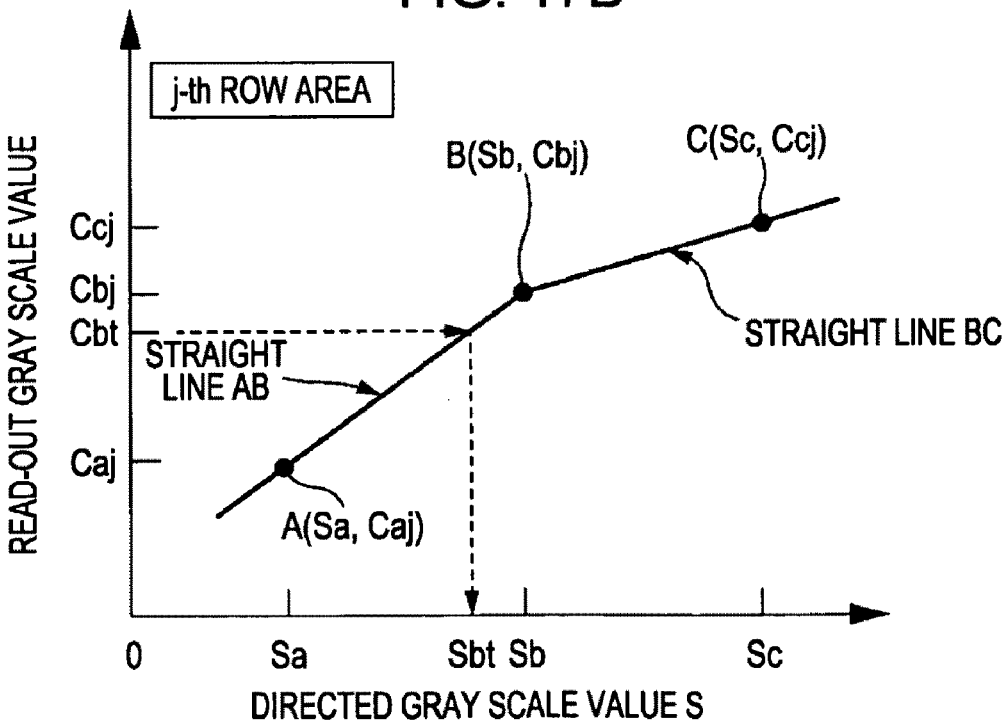

FIG. 17B is a diagram showing a method of calculating the target gray scale value Sbt for the j-th row area for which the read-out result is larger than the target gray scale value Cbt. On the graph, the read-out results of cyan of the j-th row area are plotted. A target directed gray scale value Sbt for the j-th row area represented by the target value Cbt for the directed gray scale value Sb is calculated by using the following equation (linear interpolation on the basis of a straight line AB).

$$Sbt=Sa+(Sb-Sa)\times[(Cbt-Caj)/(Cbj-Caj)]$$

As described above, after the target directed gray scale values Sbt for which density of each row area represented by the target value Cbt are calculated for the directed gray scale value Sb, the correction values H for the directed gray scale value Sb of each row area are calculated by using the following equation.

$$Hb=(Sbt-Sb)/Sb$$

Similarly, five correction values (Ha, Hb, Hc, Hd, and He) for five directed gray scale values (Sa, Sb, Sc, Sd, and Se) are calculated for each row area. In addition, the correction values H of nozzle rows other than cyan are also calculated.

S005: Storage of Correction Value H

FIG. 18 is a correction value table. After the correction values H are calculated, the correction values H are stored in a memory 13 of the printer 1. In the correction value table, five correction values (Ha_i, Hb_i, Hc_i, Hd_i, and He_i) for five directed gray scale values are assigned for each row area i. According to this embodiment, the correction values H are calculated for the number N (=180×n) of nozzles included in the printer 1.

Usage of User

In the manufacturing process of the printer 1, after the correction values H for correcting non-uniformity of density are calculated to be stored in the memory 13 of the printer, the printer 1 is shipped. Then, when a user installs the printer driver for using the printer 1, the printer driver requests the printer 1 to transmit the correction values H, which are stored in the memory 13, to the computer 50. The printer driver stores the correction values H, which are transmitted from the printer 1, in a memory mounted inside the computer 50.

Then, when receiving a print command from the user, the printer driver converts image data output from an application program into resolution for being printed on a sheet S by performing a resolution converting process. Next, the printer driver converts RGB data into CMYK data that is represented by a CMYK color space corresponding to ink of the printer 1 by performing a color converting process.

Thereafter, a gray scale value of a high gray scale that represents the pixel data is corrected by using the correction value H. The printer driver corrects the gray scale values (hereinafter, referred to as a gray scale value S_in before correction) of each pixel data based on the correction value H of a row area corresponding to the pixel data (hereafter, referred to as a gray scale value S_out after correction).

When the gray scale value S_in before correction is the same as any of Sa, Sb, Sc, Sd, and Se, the correction values Ha, Hb, Hc, Hd, and He that are stored in the memory of the computer 50 can be directly used. For example, when the gray scale value before correction S_in=Sc, the gray scale value after correction S_out is acquired by using the following equation.

$$S_out = Sc \times (1 + Hc)$$

Figure 19:
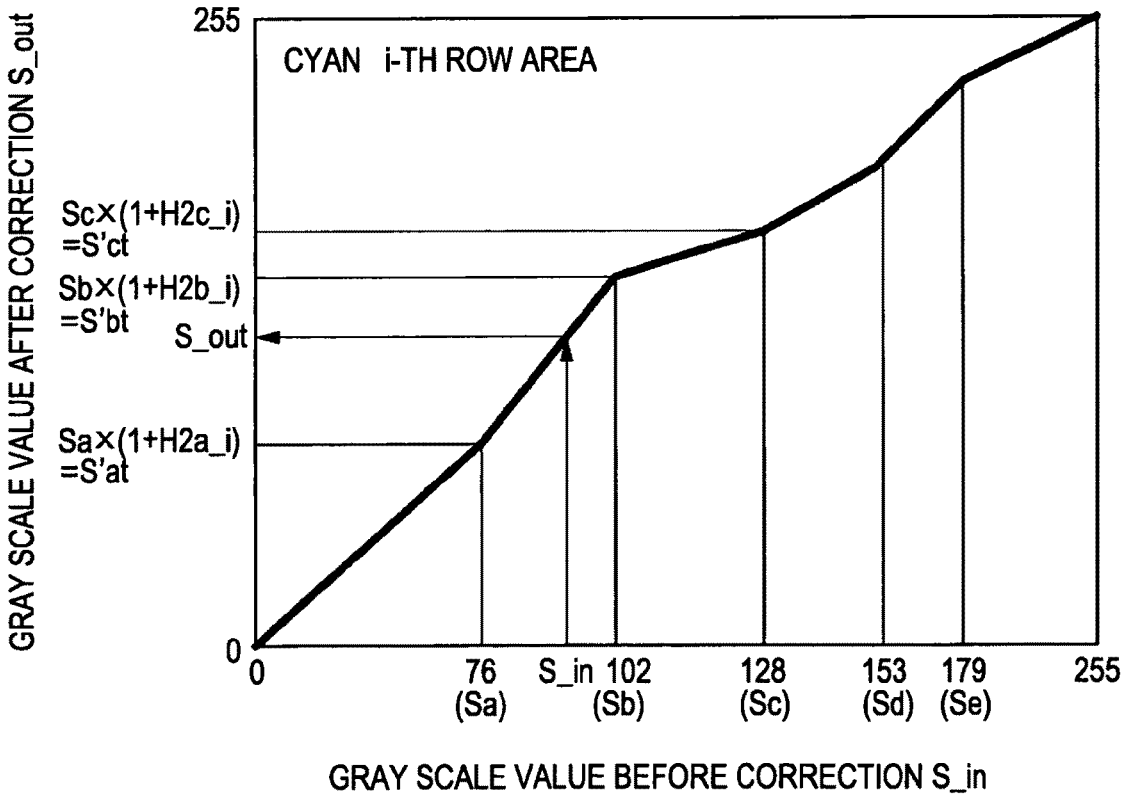
FIG. 19 is a diagram showing a case where a gray scale value before correction is different from a directed gray scale value.

FIG. 19 is a diagram showing a correction method for a case where the gray scale value before correction S_in of i-th row area of cyan is different from the directed gray scale values. The horizontal axis represents a gray scale value before correction S_in, and the vertical axis represents a gray scale value after correction S_out. When the gray scale value before correction S_in is between the directed gray scale values Sa and Sb, the gray scale value after correction S_out is calculated based on a correction value Ha of the directed gray scale value Sa and a correction value Hb of the directed gray scale value Sb through linear interpolation by using the following equation.

$$S_out = Sa + (S'bt - S'at) \times [(S_in - Sa)/(Sb - Sa)]$$

In addition, when the gray scale value before correction S_in is smaller than the directed gray scale value Sa, the gray scale value after correction S_out is calculated by performing linear interpolation of the gray scale value of "0" (minimum gray scale value) and the directed gray scale value Sa. On the other hand, when the gray scale value before correction S_in is larger than the directed gray scale value Sc, the gray scale value after correction S_out is calculated by performing linear interpolation of the gray scale value of "255" (maximum gray scale value) and the directed gray scale value Sc. The correction method is not limited thereto, and it may be configured that a correction value H_out corresponding to the gray scale value before correction S_in other than the directed gray scale value is calculated, and the gray scale value after correction S_out is calculated (S_out=S_in×(1+H_out).

After performing a density correcting process for each row area as described above, data of the high gray scale number is converted into data of a gray scale number that can be formed by the printer 1 by performing a half-tone process. Finally, by performing a rasterizing process, the image data in the form of a matrix can be arranged and switched in the order of data to be transmitted to the printer 1 for each pixel data. The print data generated through the above-described process is transmitted to the printer 1 together with command data (transport amount or the like) corresponding to the print mode by the printer driver.

Method of Calculating Correction Value

Second Embodiment

Figure 20A:
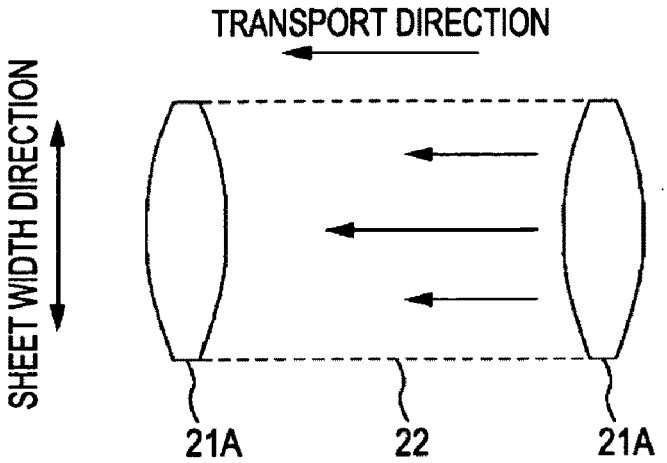
FIG. 20A is a top view of transport rollers.

FIG. 20A is a top view of transport rollers 21A and 21B. The printer 1 according to this embodiment, as shown in FIG. 2B, transports a sheet by using the transport belt 22 and the transport rollers 21A and 21B. In particular, the transport belt 22 of a printer that prints a large-sized sheet may be easily bent. Accordingly, as shown in FIG. 20A, the center portions of the transport rollers 21A and 21B are formed to be thick so as to apply tension to the transport belt 22. In such a case, a speed difference is generated between the center portion and the end portion in the sheet width direction on the transport belt 22. Thus, the center portion in the sheet width direction tends to have speed higher than that of the end portion. At this moment, when a sheet is not fed with the center portion of the transport belt 22 in the sheet width direction used as a reference, the sheet may be inclined during the transport process.

Figure 20B:
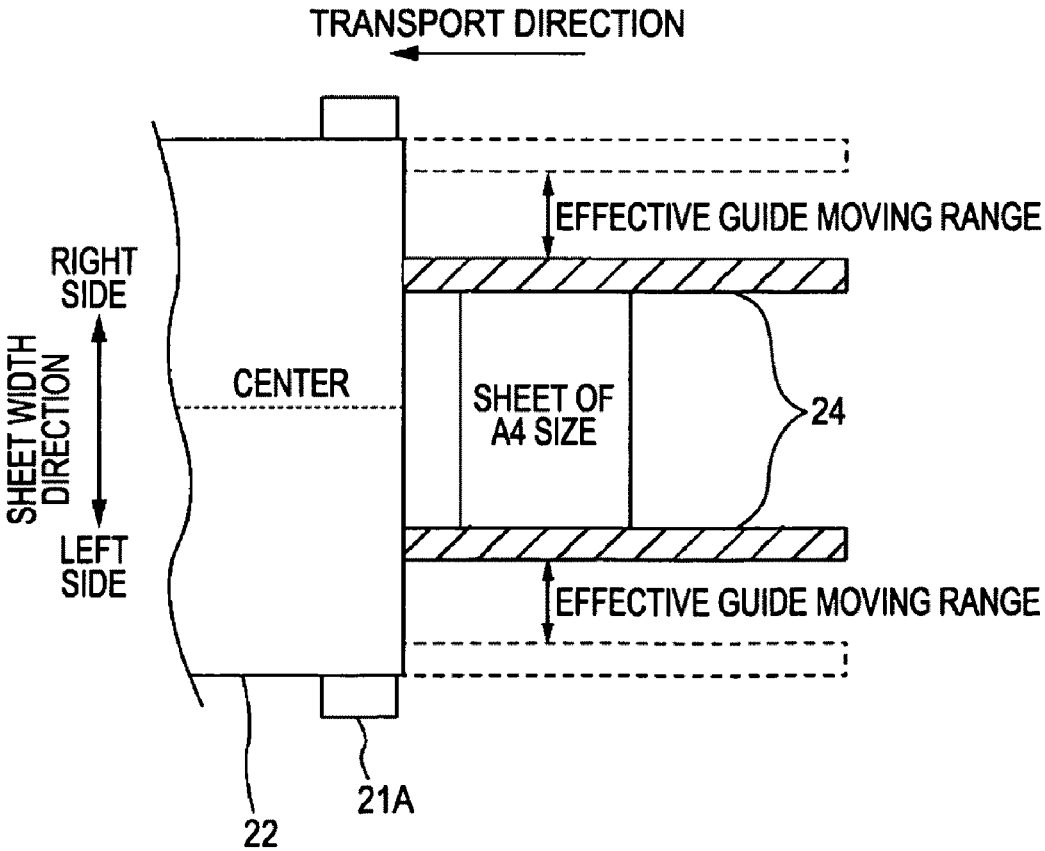
FIG. 20B is a diagram showing a transport guide.

FIG. 20B is a diagram showing transport guides 24 for transporting a sheet to a print area. A sheet is fed to the transport belt 22 along the transport guides 24 disposed on left and right sides in the sheet width direction, and whereby the sheet is fed without being inclined. When the transport guides 24 move with the center portion of the transport belt 22 in the sheet width direction used as the reference, a small-sized sheet (for example, a sheet of A4 size) cannot be moved and fed to the right end of the transport belt 22.

In the above-described first embodiment, for a printer that prints a large-sized sheet (for example, a sheet of A2 size) exceeding the read-out range of the scanner, the correction patterns are printed into small-sized sheets (for example, sheets of A4 size) by several times. In the first embodiment in which the correction patterns are printed in small-sized sheets, for example, as shown in FIG. 9, the sheet needs to be moved to the right or left side of the transport belt 22. Accordingly, as a printer shown in FIGS. 20A and 20B, a printer of a type in which a sheet is fed with the center portion of the transport belt 22 used as the reference cannot print the correction patterns on a small-sized sheet.

Thus, according to the second embodiment, first, the test patterns are printed on a sheet of a size that can be printed by the printer, even when the size exceeds the read-out range of the scanner. Thereafter, the sheet is cut into sheets of a size that can be read by the scanner. Accordingly, the test patterns printed by the printer as shown in FIGS. 20A and 20B can be read by the scanner.

Figure 21:
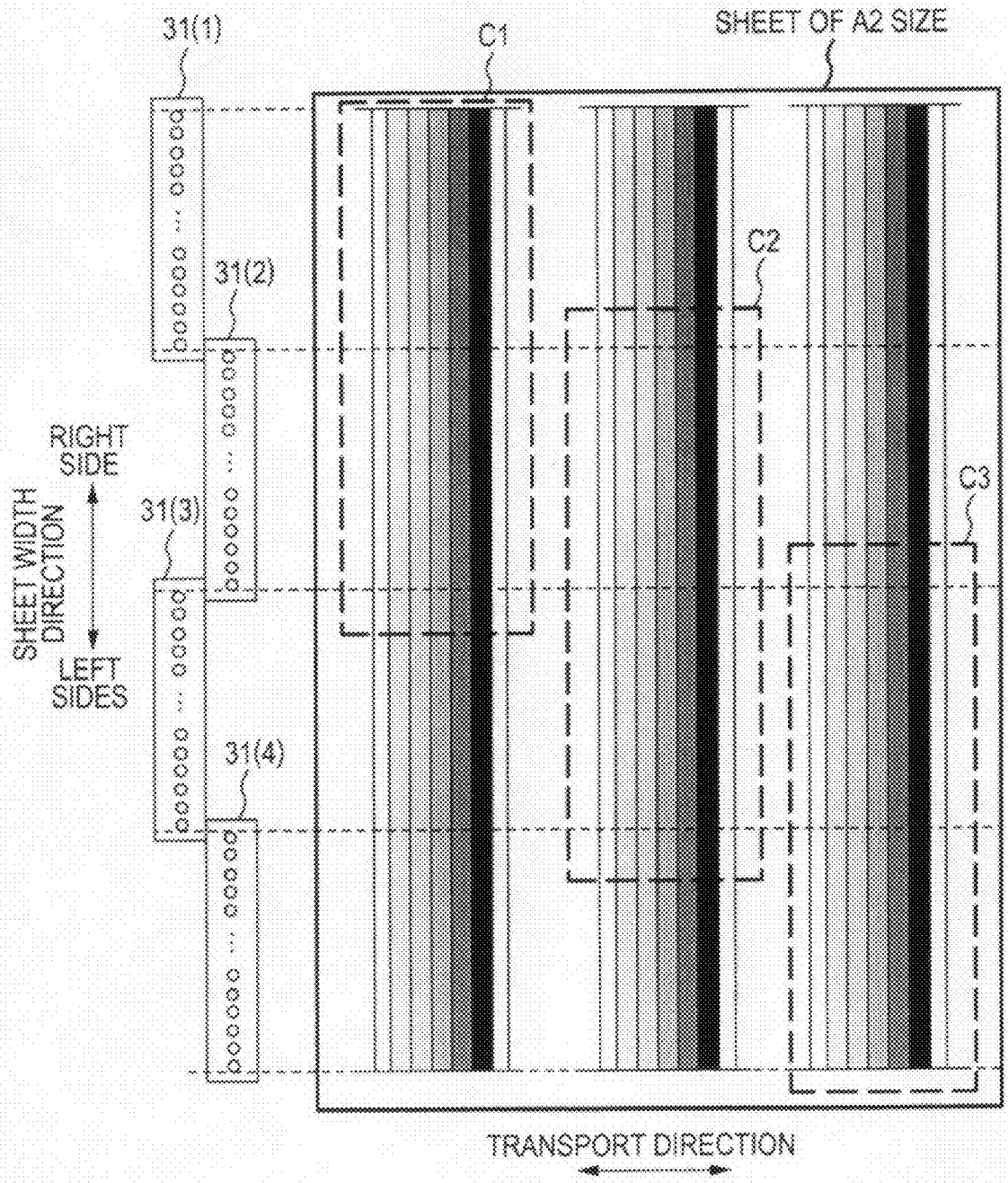
FIG. 21 is a diagram showing cutting positions of a correction pattern.

FIG. 21 is a diagram showing the cutting positions of the correction patterns printed on a sheet of A2 size by the printer 1. First, the correction patterns are printed so as to fill out a sheet of A2 size by using all the heads 31(1) to 31(4). For the convenience of description, the number of heads to be drawn is reduced. Three correction patterns printed on the sheet of A2 size shown in FIG. 21 are formed by using a same (color) nozzle row. Thereafter, in order to acquire read-out gray scale values of the correction patterns printed by the first head 31(1) and the second head 31(2), the correction patterns are cut from the sheet of A2 size in the cutting position C1 (dotted line) shown in FIG. 21. At this moment, the correction pattern needs to be cut so as to assuredly include a row area printed by the leftmost nozzle of the second head 31(2). Accordingly, a large range C1 is cut so as to include a correction pattern that is formed by a nozzle located in the right end portion of the third head 31(3). By reading the cut sheet C'1 that is cut in the cutting position C1 by using the scanner, the read-out gray scale values of the correction patterns that are formed by the first head 31(1) and the second head 31(2) can be acquired. In addition, in the cutting position C1, the correction pattern that is formed by the nozzle located in the right end portion of the third head 31(3) is included. Accordingly, the influence of the margin of the sheet on the read-out result of the correction pattern that is formed by the nozzle located in the left end portion of the second head 31(2) can be prevented.

Next, in order to acquire the read-out gray scale values of the correction patterns printed by the second head 31(2) and the third head 31(3), the correction pattern is cut in a cutting position C2 from the sheet of A2 size. At this moment, by cutting the sheet so as to include correction patterns printed by a nozzle located in the left end portion of the first head 31(1) and a nozzle located in the right end portion of the fourth head 31(4), the influence of the margin of the sheet on the read-out gray scale values of the second head and the read-out gray scale values of the third head can be prevented.

In addition, the correction pattern printed by the second head 31(2) is included in both the cutting position C1 and the cutting position C2. As a result, an "eighth read-out gray scale value" that is the read-out result of the correction pattern printed in a cutting sheet C'1 by the second head 31(2) as the read-out value of the second head and a "ninth read-out gray scale value" that is the read-out result of the correction pattern printed in the cutting sheet C'2 cut in the cutting position C2 by the second head 31(2) can be acquired. Then, the read-out error of the scanner for a case where the cut sheet C'1 is read out by the scanner and a case where the cut sheet C'2 is read-out by the scanner can be calculated based on a difference between the eighth read-out gray scale value and the ninth read-out gray scale value.

Similarly, in order to acquire the read-out gray scale values of the correction patterns printed by the third head 31(3) and the fourth head 31(4), the correction pattern is cut in a cutting position C3 from the sheet of A2 size. By having the correction pattern printed by the third head 31(3) included in both the cutting position C2 and the cutting position C3, the read-out error of the scanner for a case where the cut sheet C'2 is read out by the scanner and a case where the cut sheet C'3 cut in the cutting position C3 is read out by the scanner can be calculated.

As in the first embodiment, the corrected read-out gray scale values in which the read-out error of the scanner is resolved are calculated based on the read-out error of the scanner calculated as above, and the correction values H for each row area are calculated based on the corrected read-out gray scale values. In other words, in the second embodiment, when correction patterns printed in a sheet larger than the read-out range of the scanner is cut, the correction patterns are cut such that correction patterns printed by a nozzle or head 31 are included in both cut sheets that are not simultaneously read by the scanner. Accordingly, the read-out error of the scanner that occurs in the read-out result of the cut sheets that are not simultaneously read out by the scanner can be calculated. In FIG. 21, the correction patterns fill out the sheet face of A2 size. However, it is preferable that the correction patterns are printed in the range of the cutting positions C1 to C3.

Other Embodiments

In the above-described embodiment, a printing system having an ink jet printer has been mainly described. However, disclosure of a method of suppressing the non-uniformity of density and the like is included therein. The above-described embodiments are for easy understanding of the invention and are not for the purpose of limiting the invention. It is apparent that the invention may be changed or modified without departing from the gist of the invention, and equivalents thereof belong to the scope of the invention. In particular, embodiments described below also belong to the scope of the invention.

Liquid Discharging Device

In the above-described embodiments, as a liquid discharging device (a part) that performs a method of discharging liquid, an ink jet printer has been described as an example. However, the invention is not limited thereto. The liquid discharging device may be applied to various industrial apparatuses other than a printer (printing device). For example, the invention may be applied to a coloring device for attaching shapes to a cloth, a display manufacturing apparatus such as a color filter manufacturing apparatus or an organic EL display, a DNA chip manufacturing apparatus that manufactures a DNA chip by coating a solution into which DNA is melt, a circuit board manufacturing apparatus, and the like.

In addition, a liquid discharging type may be a piezo type in which liquid is discharged by applying a voltage to a driving element (piezo element) so as to expand or contract an ink chamber or a thermal type in which air bubbles are generated inside a nozzle by using a heating element and liquid is discharged by using the air bubbles.

Printer

In the above-described embodiments, a line head printer is exemplified in which nozzles are aligned in the sheet width direction interesting the transport direction of a medium. However, the invention is not limited thereto. For example, a printer in which a dot forming operation for forming a dot row along the moving direction and a transport operation (moving operation) for transporting a sheet in the transport direction that is the nozzle row direction are repeated while a head unit is moved in the moving direction intersecting the nozzle row direction may be used. In a case where the test patterns printed by the printer is larger than the read-out range of the scanner, when at least one nozzle prints test patterns on two media that are not simultaneously read by the scanner, the read-out error of the scanner can be resolved.

In addition, in the printer, in a band printing process in which after a band image is printed once in the moving direction (path) of the head unit, a sheet is transported by a length corresponding to the band image, and a band image is printed again, a raster line formed by a pass is not printed between raster lines formed by another pass. Accordingly, same as in the above-described line head printer, between raster lines formed by a head, a raster line formed by another head is not formed. However, in an interlaced printing process in which, between the raster line recorded by one pass, a raster line that is not recorded by the pass is interlaced, between raster lines formed by a head, a raster line is formed by another head. Even in such a case, for example, when a test pattern that is configured by a first dot row group, a second dot row group, and a third dot row group is printed in several sheets of a small size (or after the test pattern is printed on a large-sized sheet, the sheet is cut), the second dot group is configured to be included in both sheets that are not simultaneously read by the scanner. Accordingly, the read-out error of the scanner can be corrected based on the difference between the read-out results of the second nozzle group that are not simultaneously read by the scanner.

Head 31

In the above-described embodiments, as shown in FIG. 3, a line head printer in which a plurality of heads 31 is aligned along the sheet width direction has been described as an example. However, the invention is not limited thereto. For example, a printer having one head that includes a long nozzle row in the sheet width direction may be used. When the test pattern formed by the long nozzle row in the sheet width direction exceeds the read-out range of the scanner, it is preferable that the test patterns are printed with the nozzle row divided into a plurality of nozzle groups. In such a case, for two media that are not simultaneously read by the scanner, when at least one nozzle prints test patterns on the two media, the read-out error of the scanner can be resolved.

What is claimed is:

1. A method of calculating a correction value, the method comprising:

forming a first test pattern on a medium by using a first nozzle group and a second nozzle group of a liquid discharging device including a nozzle row, in which a plurality of nozzles for discharging liquid is aligned in a predetermined direction, having the first nozzle group, the second nozzle group, and a third nozzle group;

forming a second test pattern on the medium by using the second nozzle group and the third nozzle group of the liquid discharging device;

setting the first test pattern in a scanner, acquiring a read-out result of a portion formed by the first nozzle group from a read-out result of the first test pattern as a first read-out gray scale value, and acquiring a read-out result of a portion formed by the second nozzle group from a read-out result of the first test pattern as a second read-out gray scale value;

setting the second test pattern other than the first test pattern in the scanner, acquiring a read-out result of a portion formed by the second nozzle group from a read-out result of the second test pattern as a third read-out gray scale value, and acquiring a read-out result of a portion formed by the third nozzle group from a read-out result of the second test pattern as a fourth read-out gray scale value;

converting the first read-out gray scale value, the second read-out gray scale value, the third read-out gray scale value, and the fourth read-out gray scale value into corrected read-out gray scale values by correcting at least one between the read-out result of the first test pattern and the read-out result of the second test pattern based on a difference between the second read-out gray scale value and the third read-out gray scale value; and calculating a correction value based on the corrected read-out gray scale values.

2. The method according to claim 1, wherein the first nozzle group, the second nozzle group, and the third nozzle group are aligned in the described order from one side in the predetermined direction, and wherein, in the converting of the first to fourth read-out gray scale values into the corrected read-out gray scale values, the difference between the second read-out gray scale value and the third read-out gray scale value is calculated based on a difference between an average value of the second read-out gray scale values of the second nozzle group, from which the read-out result of the first test pattern formed by the nozzle located in an end portion on the other side is excluded, and an average value of the third read-out gray scale values of the second nozzle group from which the read-out result of the second test pattern formed by the nozzle located in an end portion on the one side is excluded.

3. The method according to claim 1, wherein the first nozzle group, the second nozzle group, and the third nozzle group are aligned in the described order from one side in the predetermined direction, and the first nozzle group, the second nozzle group, and the third nozzle group belong to different heads, and wherein, in the converting of the first to fourth read-out gray scale values into the corrected read-out gray scale values, the difference between the second read-out gray scale value and the third read-out gray scale value is calculated based on a difference between an average value of the second read-out gray scale values of the second nozzle group, from which the read-out result of the first test pattern formed by the nozzle located in an end portion on the one side is excluded, and an average value of the third read-out gray scale values of the second nozzle group from which the read-out result of the second test pattern formed by the nozzle located in an end portion on the other side is excluded.

4. The method according to claim 1, wherein the corrected read-out gray scale value corresponding to the third nozzle group is the fourth read-out gray scale value that is corrected by the difference between the second read-out gray scale value and the third read-out gray scale value.

5. The method according to claim 1, wherein the corrected read-out gray scale value corresponding to the first nozzle group is the first read-out gray scale value that is corrected by a part of the difference between the second read-out gray scale value and the third read-out gray scale value, wherein the corrected read-out gray scale value corresponding to the second nozzle group is the second read-out gray scale value that is corrected by a part of the difference, and wherein the corrected read-out gray scale value corresponding to the third nozzle group is the fourth read-out gray scale value that is corrected by a remaining amount of the difference between the second read-out gray scale value and the third read-out gray scale value from which the part is excluded.

6. The method according to claim 1, wherein the first nozzle group, the second nozzle group, and the third nozzle group are aligned in the described order from one side in the predetermined direction, wherein the first test pattern is formed on the medium by using the first nozzle group, the second nozzle group, and the nozzle of the third nozzle group that is located on an end portion on the one side, and wherein the second test pattern is formed on the medium by using the nozzle of the first nozzle group that is located in an end portion on the other side, the second nozzle group, and the third nozzle group.

7. The method according to claim 1, wherein the first nozzle group, the second nozzle group, and the third nozzle group are aligned in the described order from one side in the predetermined direction, wherein the corrected read-out gray scale value corresponding to an end portion of the second nozzle group on the one side is the second read-out gray scale value that is corrected by the difference between the second read-out gray scale value and the third read-out gray scale value, and wherein the corrected read-out gray scale value corresponding to an end portion of the second nozzle group on the other side is the third read-out gray scale value that is corrected by the difference between the second read-out gray scale value and the third read-out gray scale value.

8. A method of discharging liquid, the method comprising:

forming a first test pattern on a medium by using a first nozzle group and a second nozzle group of a liquid discharging device including a nozzle row, in which a plurality of nozzles for discharging liquid is aligned in a predetermined direction, having the first nozzle group, the second nozzle group, and a third nozzle group;

forming a second test pattern on the medium by using the second nozzle group and the third nozzle group of the liquid discharging device;

setting the first test pattern in a scanner, acquiring a read-out result of a portion formed by the first nozzle group from a read-out result of the first test pattern as a first read-out gray scale value, and acquiring a read-out result of a portion formed by the second nozzle group from a read-out result of the first test pattern as a second read-out gray scale value;

setting the second test pattern other than the first test pattern in the scanner, acquiring a read-out result of a portion formed by the second nozzle group from a read-out result of the second test pattern as a third read-out gray scale value, and acquiring a read-out result of a portion formed by the third nozzle group from a read-out result of the second test pattern as a fourth read-out gray scale value;

converting the first read-out gray scale value, the second read-out gray scale value, the third read-out gray scale value, and the fourth read-out gray scale value into corrected read-out gray scale values by correcting at least one between the read-out result of the first test pattern and the read-out result of the second test pattern based on a difference between the second read-out gray scale value and the third read-out gray scale value;

calculating a correction value based on the corrected read-out gray scale values; and correcting a gray scale value represented by image data by using the correction value and discharging liquid based on a corrected gray scale value by using the liquid discharging device.

9. A method of calculating a correction value, the method comprising:

forming a first test pattern having a first dot row group and a second dot row group on a medium by using a liquid discharging device that alternately repeats forming a dot row, in which dots are aligned in an intersection direction, with a nozzle row, in which a plurality of nozzles for discharging liquid is aligned in a predetermined direction, and the medium relatively moved in the intersection direction intersecting the predetermined direction and relatively moving the nozzle row and the medium in the predetermined direction;

forming a second test pattern having a second dot row group and a third dot row group on the medium by using the liquid discharging device;

setting the first test pattern in a scanner, acquiring a read-out result of the first dot row group as a first read-out gray scale value, and acquiring a read-out result of the second dot row group as a second read-out gray scale value;

setting the second test pattern other than the first test pattern in the scanner, acquiring a read-out result of the second dot row group as a third read-out gray scale value, and acquiring a read-out result of the third dot row group as a fourth read-out gray scale value;

converting the first read-out gray scale value, the second read-out gray scale value, the third read-out gray scale value, and the fourth read-out gray scale value into corrected read-out gray scale values by correcting at least one between the read-out result of the first test pattern and the read-out result of the second test pattern based on a difference between the second read-out gray scale value and the third read-out gray scale value; and calculating a correction value based on the corrected read-out gray scale values.

* * * * *